US007273267B2

(12) United States Patent
Yokouchi et al.

(10) Patent No.: US 7,273,267 B2
(45) Date of Patent: Sep. 25, 2007

(54) BUBBLE-ELIMINATING LIQUID FILLING METHOD, DROPLET DISCHARGING APPARATUS, AND INKJET RECORDING APPARATUS

(75) Inventors: Tsutomu Yokouchi, Kanagawa (JP); Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 265 days.

(21) Appl. No.: 10/951,818

(22) Filed: Sep. 29, 2004

(65) Prior Publication Data

US 2005/0068373 A1 Mar. 31, 2005

(30) Foreign Application Priority Data

Sep. 30, 2003 (JP) ..... 2003-342291

(51) Int. Cl.
*B41J 2/045* (2006.01)

(52) U.S. Cl. ..... 347/70; 347/92

(58) Field of Classification Search ..... 347/20, 347/45, 47, 56, 63, 65, 67–71, 92–94
See application file for complete search history.

(56) References Cited

U.S. PATENT DOCUMENTS 4,794,410 A * 12/1988 Taub et al. ..... 347/92
5,649,359 A 7/1997 Murakami et al. ..... 347/45
5,703,630 A 12/1997 Murakami et al. ..... 347/45
6,273,539 B1 * 8/2001 Suzuki ..... 347/70
6,290,341 B1 * 9/2001 Furuhata et al. ..... 347/70

FOREIGN PATENT DOCUMENTS

| | | | |
|---|---|---|---|
| JP | 3-36037 | A | 2/1991 |
| JP | 5-124198 | A | 5/1993 |
| JP | 5-318725 | A | 12/1993 |
| JP | 6-71885 | A | 3/1994 |
| JP | 8-108535 | A | 4/1996 |
| JP | 2001-121695 | A | 5/2001 |

* cited by examiner

*Primary Examiner*—Juanita D. Stephens
(74) *Attorney, Agent, or Firm*—Birch, Stewart, Kolasch & Birch, LLP

(57) ABSTRACT

The liquid filling method is for filling a liquid into a liquid discharge apparatus comprising a nozzle which discharges a droplet of the liquid, a pressure chamber which is in communication with the nozzle and is filled with the liquid to be discharged as the droplet through the nozzle, and a pressure generation device which generates pressure variation in the liquid inside the pressure chamber to cause the droplet to be discharged through the nozzle, and the method comprises the steps of: adjusting a contact angle of the liquid on an inner surface of the pressure chamber to be not more than an angle formed inside the pressure chamber by two mutually adjacent surfaces constituting the inner surface; and filling the liquid into the pressure chamber.

18 Claims, 23 Drawing Sheets

LIQUID FLLOWS IN

BUBBLE REMAINS

NO BUBBLE REMAINS

| TEMPERATURE | | SURFACE TENSION (mN/m) |
|---|---|---|
| 0°C | → | 75.62 |
| 25°C | → | 71.96 |
| 90°C | → | 60.74 |

| TEMPERATURE | | CONTACT ANGLE |
|---|---|---|
| 25°C | → | ABOUT 108° |
| 90°C | → | ABOUT 92° |

BUBBLE-ELIMINATING LIQUID FILLING METHOD, DROPLET DISCHARGING APPARATUS, AND INKJET RECORDING APPARATUS

This Nonprovisional application claims priority under 35 U.S.C. § 119(a) on patent application Ser. No(s). 2003-342291 filed in Japan on Sep. 30, 2003, the entire contents of which are hereby incorporated by reference.

BACKGROUND OF THE INVENTION

1. Field of the Invention

The present invention relates to a liquid discharge method, droplet discharging apparatus, and inkjet recording apparatus, and more specifically to a liquid filling method that effectively eliminates bubbles inside a pressure chamber in communication with a nozzle (droplet discharging port), to a droplet discharging apparatus, and to an inkjet recording apparatus that uses the discharge apparatus.

2. Description of the Related Art

In an inkjet recording head, pressure is applied to liquid inside a pressure chamber to discharge droplets of the liquid through a nozzle connected to the pressure chamber. If bubbles are present in the pressure chamber, there is a drawback in that no droplet is discharged because energy is expended on shrinking the bubbles when the pressure is applied to the liquid. Bubbles are easily formed in the pressure chamber when the liquid is filled thereinto. For this reason, the pressure chamber must be designed so that no bubble remains therein.

As methods that do not leave bubbles inside the head, or that effectively remove bubbles inside the head, several methods have been proposed whereby the interior of the pressure chamber is subjected to hydrophilization treatment (Japanese Patent Application Publication Nos. 5-124198, 5-318725, 6-71885, and 8-108535).

The inkjet recording head disclosed in Japanese Patent Application Publication No. 5-124198 features a crater portion formed in the nozzle plate, and the crater portion, the inside walls of the head, and ink flow channels are subjected to hydrophilization treatment. Cited therein is the preference that the hydrophilization treatment be carried out so that a contact angle of purified water at normal temperature on the treated surface is 10° or less. However, this configuration requires a nozzle plate with a complicated structure, and considerable labor is required in its fabrication.

In the inkjet recording head disclosed in Japanese Patent Application- Publication No. 5-318725, the cover plate with flow channels has a two-layer structure, the contact angle of the ink on the layer on the side in contact with the ink is 90° or less, and the contact angle of the ink on the layer on the side not in contact with the ink is 90° or greater. However, this configuration has a complex structure because the cover plate has the two layers.

The inkjet recording head disclosed in Japanese Patent Application Publication No. 6-71885 is configured so that at least a portion of the ink-contacting area inside the head is subjected to hydrophilization treatment with an ion injection method. Also disclosed in this publication is an aspect in which an orifice plate (equivalent to a nozzle plate) is formed with a water-repellent material, and the reverse surface of the discharge port formation surface is subjected to the hydrophilization treatment. However, this configuration uses the ion injection method, so that the hydrophilization treatment step is rather labor intensive.

The inkjet recording head disclosed in Japanese Patent Application Publication No. 8-108535 is a plastic head, and the contact angle of the ink on the inner surface of the ink flow channels is 10° or less. However, this configuration is limited to a plastic head, and cannot be applied to heads manufactured using materials (stainless steel or the like, for example) other than plastic.

SUMMARY OF THE INVENTION

The present invention is contrived in view of such circumstances, and an object thereof is to provide a liquid filling method that can prevent residual bubbles (in particular, residual bubbles in a pressure chamber during liquid filling) in the head by means of a simple configuration, a droplet discharging apparatus, and an inkjet recording apparatus that uses the discharge apparatus.

In order to attain the aforementioned object, the present invention is directed to a liquid filling method of filling a liquid into a liquid discharge apparatus comprising a nozzle which discharges a droplet of the liquid, a pressure chamber which is in communication with the nozzle and is filled with the liquid to be discharged as the droplet through the nozzle, and a pressure generation device which generates pressure variation in the liquid inside the pressure chamber to cause the droplet to be discharged through the nozzle, the method comprising the steps of: adjusting a contact angle of the liquid on an inner surface of the pressure chamber to be not more than an angle formed inside the pressure chamber by two mutually adjacent surfaces constituting the inner surface; and filling the liquid into the pressure chamber.

According to the present invention, by keeping the contact angle of the liquid that makes contact with inner surfaces of the pressure chamber equal to or less than the angle of the corner portion of the pressure chamber, it is possible to cause the liquid to make contact with the corner portion of the pressure chamber in the liquid inflow process during liquid filling, and to cause the liquid to thereafter make contact with the next inner surface, preventing bubbles from being left in the corner portion.

The present invention also provides an apparatus for implementing the above-described method. More specifically, the present invention is also directed to a droplet discharging apparatus, comprising: a nozzle which discharges a droplet of a liquid; a pressure chamber which is in communication with the nozzle and is filled with the liquid to be discharged as the droplet through the nozzle; and a pressure generation device which generates pressure variation in the liquid inside the pressure chamber to cause the droplet to be discharged through the nozzle, wherein a contact angle of the liquid on an inner surface of the pressure chamber is not more than an angle formed inside the pressure chamber by two mutually adjacent surfaces constituting the inner surface.

Examples of acceptable aspects that satisfy such conditions is selected include those in which a combination of the members used and the shape of the pressure chamber and the liquid, those in which the surfaces of the constituent members of the inner surfaces of the pressure chamber are rendered liquid-philic, those in which the surface tension of the liquid is controlled, and combinations of these aspects.

Preferably, the contact angle of the liquid on the inner surface is not more than a minimum of angles formed inside the pressure chamber by respective two mutually adjacent surfaces constituting the inner surface.

If the angle of a corner portion formed by two mutually adjacent surfaces of the inner wall that define the space of the pressure chamber differs according to location, and corner portions with a plurality of types of angles are present, then bubbles can be prevented from remaining in any of the corner portions during liquid filling by maintaining a contact angle of the liquid that is equal to or less than the minimum angle.

In an aspect of the present invention, the inner surface includes a bottom surface in which a flow port is formed in communication with the nozzle, a top surface which faces the bottom surface, and a side surface which connects the bottom surface and the top surface; and the contact angle of the liquid on the side surface is not more than the angle formed inside the pressure chamber by two mutually adjacent surfaces constituting the inner surface.

Of the inner surfaces of the pressure chamber, two mutually adjacent surfaces composed of the top surface and side surface, the bottom surface and side surface, or mutual side surfaces each form a corner portion. Of these, it is particularly effective for the side surfaces to be used when the contact angles thereof satisfy the condition in which the contact angle is equal to or less than the angle of the corner portion.

In an aspect of the present invention, the pressure chamber is configured in a substantially polygonal shape viewed from a droplet discharging direction, and the contact angle of the liquid on the side surface is not more than a minimum of internal angles of the substantially polygonal shape.

Preferably, the droplet discharging apparatus further comprises a heating device which heats the liquid when the liquid is filled into the pressure chamber so as to adjust the contact angle of the liquid. The surface tension of the liquid is changed by controlling the temperature of the solution with a heating device, and the contact angle of the liquid on the inner surfaces of the pressure chamber is adjusted so as to be equal to or less than the angle of the corner portion when the liquid is being filled. In accordance with the aspect in which the temperature of the liquid is adjusted by the heating device, the degree of freedom for selecting the type of liquid, the material of the inner surfaces of the pressure chamber, the surface treatment, and other options is increased.

The present invention is also directed to a droplet discharging apparatus, comprising: a nozzle which discharges a droplet of a liquid; a pressure chamber which is in communication with the nozzle and is filled with the liquid to be discharged as the droplet through the nozzle; and a pressure generation device which generates pressure variation in the liquid inside the pressure chamber to cause the droplet to be discharged through the nozzle, wherein a liquid-philic portion is arranged on an inner surface of the pressure chamber in a first area including a region nearby a corner formed by two mutually adjacent surfaces constituting the inner surface, and a low liquid-philicity portion with liquid-philicity lower than the liquid-philic portion is arranged on the inner surface in a second area other than the first area.

According to the present invention, the liquid-philic properties of the inner surface of the pressure chamber have a distributed nature, that is, a corner portion (end portion) in which bubbles easily remain is made into a liquid-philic portion whose liquid-philicity is relatively high, other areas are made into a low liquid-philicity portion with relatively low liquid-philicity, and the contact angles are made non-uniform at the respective portions.

The low-liquid-philicity portion may be formed by not carrying out liquid-philization treatment, by carrying out liquid-philization treatment with lower liquid-philicity than the liquid-philic portion, or by carrying out liquid-phobization treatment.

In an aspect of the present invention, the inner surface includes a bottom surface in which a flow port is formed in communication with the nozzle, a top surface which faces the bottom surface, and a side surface which connects the bottom surface and the top surface; entire of the side surface is the liquid-philic portion; and each of the top and bottom surfaces includes the low liquid-philicity portion. In accordance with this aspect, liquid can be filled first from a location in which bubbles easily remain during liquid filling, and the bubble elimination characteristics can be improved.

In particular, a structure in which solely the side surfaces of the pressure chamber are subjected to hydrophilization treatment and the top and bottom surfaces remain untreated allows manufacturing to be facilitated by introducing a manufacturing step in which flow channel plates are laminated together.

The present invention is also directed to an inkjet recording apparatus which performs recording of an image on a recording medium, the apparatus comprising: an inkjet recording head which includes the above-described droplet discharging apparatus for discharging droplets of ink onto the recording medium; and a conveyance device which conveys at least one of the inkjet recording head and the recording medium relatively to each other during the recording.

In the implementation of the present invention, the shape of the recording head is not particularly limited, and the recording head may be a shuttle-type recording head that prints as the recording head reciprocates in the direction that is substantially orthogonal to the feed direction of the recording medium, or a full-line recording head having nozzle rows in which a plurality of nozzles for discharging ink are arrayed across a length that corresponds to the entire width of the recording medium in a direction that is substantially orthogonal to the feed direction of the recording medium.

A "full-line recording head (droplet discharging head)" is normally disposed along the direction orthogonal to the relative feed direction (direction of relative movement) of the printing medium, but also possible is an aspect in which the recording head is disposed along the diagonal direction given a predetermined angle with respect to the direction orthogonal to the feed direction. The array form of the nozzles in the recording head is not limited to a single row array in the form of a line, and a matrix array composed of a plurality of rows is also possible. Also possible is an aspect in which a plurality of short-length recording head units having a row of nozzles that do not have lengths that correspond to the entire width of the printing medium are combined, whereby the image-recording element rows are configured so as to correspond to the entire width of the printing medium, with these units acting as a whole.

The "recording medium" is a medium (an object that may be referred to as a print medium, image formation medium, recording medium, image receiving medium, or the like) that receives images recorded by the action of the recording head and includes continuous paper, cut paper, seal paper, OHP sheets, and other resin sheets, as well as film, cloth, printed substrates on which wiring patterns or the like are formed with an inkjet recording apparatus, and various other media without regard to materials or shapes. In the present specification, the term "printing" expresses the concept of not only the formation of characters, but also the formation of images with a broad meaning that includes characters.

The term "moving device (conveyance device)" includes an aspect in which the printing medium is moved with respect to a stationary (fixed) recording head, an aspect in which the recording head is moved with respect to a stationary printing medium, or an aspect in which both the recording head and the printing medium are moved.

In accordance with the present invention, the contact angle of the liquid on the inner surfaces of the pressure chamber satisfies the condition that the contact angle be equal to or less than the angle of the corner portion of the pressure chamber, so that bubbles can be prevented from remaining in the pressure chamber when liquid is filled thereinto.

In accordance with an aspect in which the contact angle is controlled by adjusting the temperature of the liquid using a heating device in the present invention, the degree of freedom to select the type of liquid, inner surface material, surface treatment, and other options is increased.

Formation of residual bubbles can furthermore be effectively inhibited during liquid filling by adopting an aspect in which a liquid-philic portion and a low liquid-philicity portion are provided to the inner surfaces of the pressure chamber, and in which the liquid is caused to preferentially flow to the corner portions by the action of the highly liquid-philic portion.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus (Printer)

Figure 1:
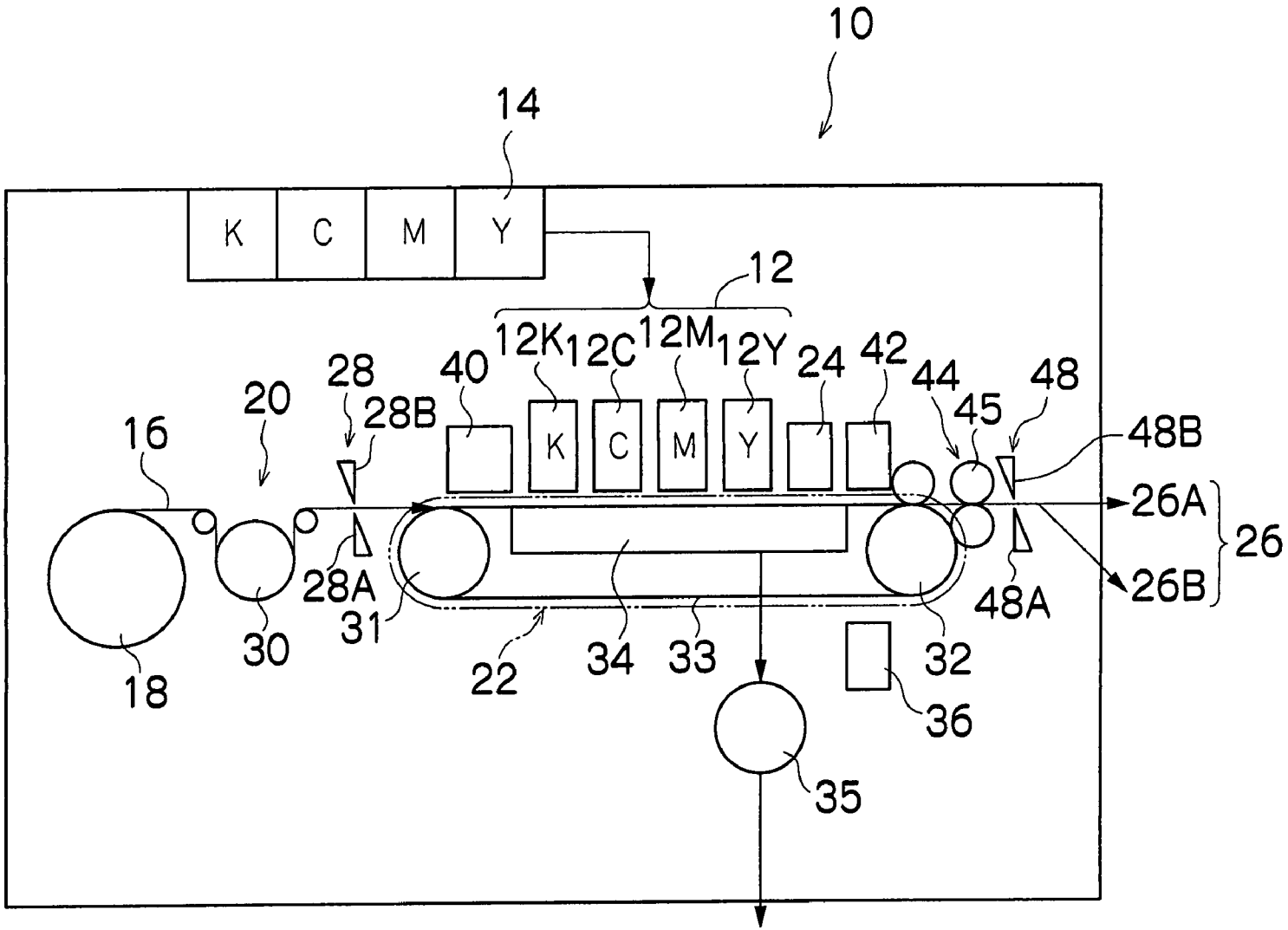
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
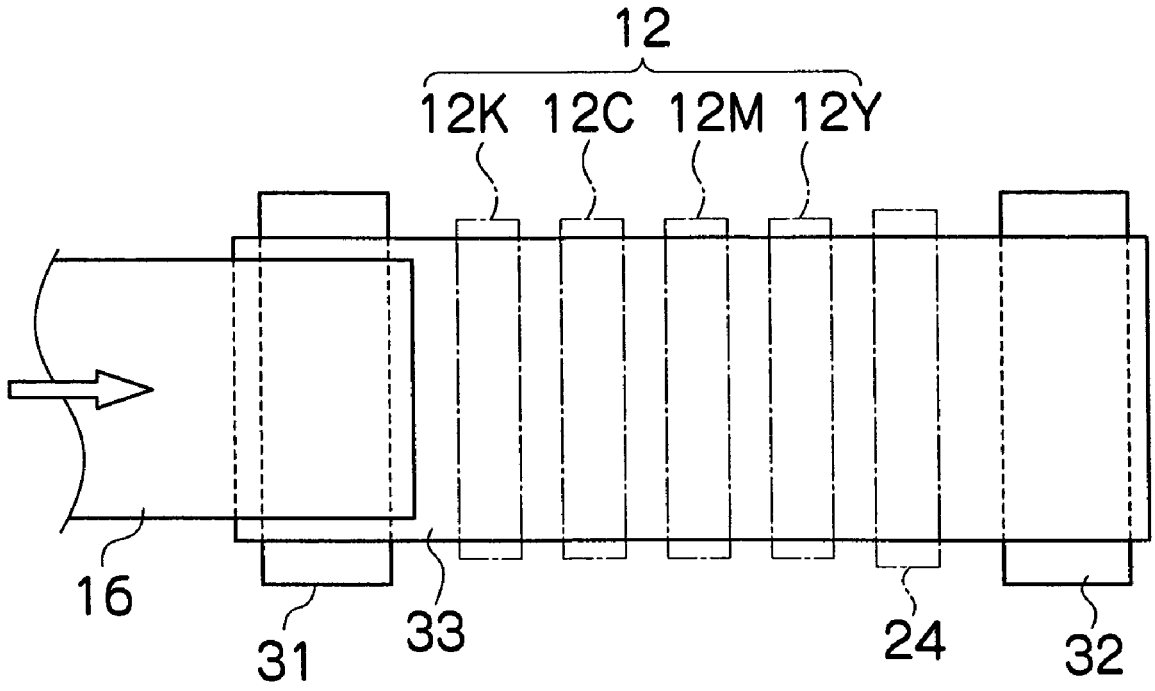
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor. The print determination unit 24 is configured with at least a line sensor or area sensor having rows of photoelectric transducing elements with a width that is greater than the ink-droplet ejection width (image recording width) of the print heads 12K, 12C, 12M, and 12Y.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Next, the structure of the print heads is described. The print heads 12K, 12C, 12M and 12Y have the same structure, and a reference numeral 50 is hereinafter designated to any of the print heads 12K, 12C, 12M and 12Y.

Figure 3A:
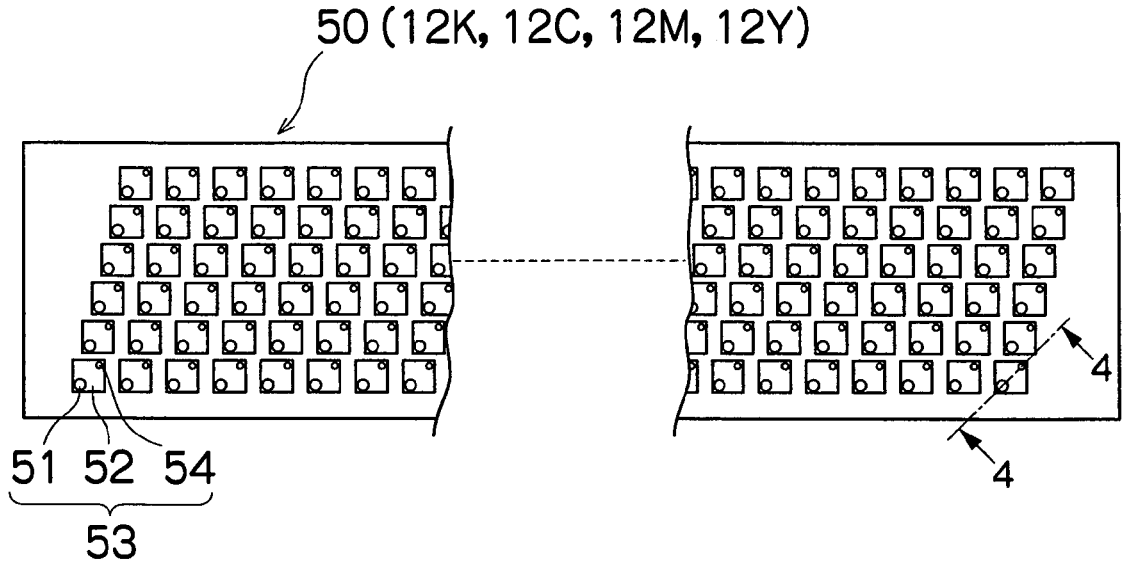
FIG. 3A is a perspective plan view showing an example of a configuration of a print head.
Figure 3B:
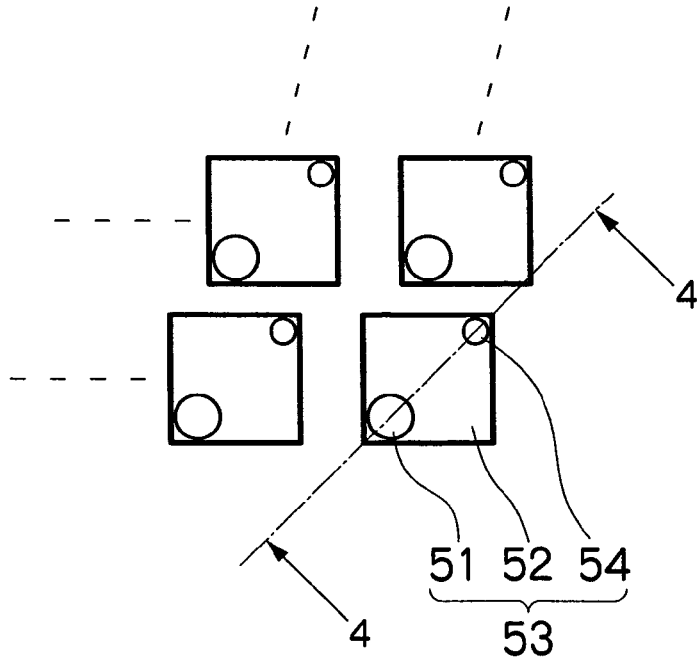
FIG. 3B is a partial enlarged view of FIG. 3A.
Figure 3C:
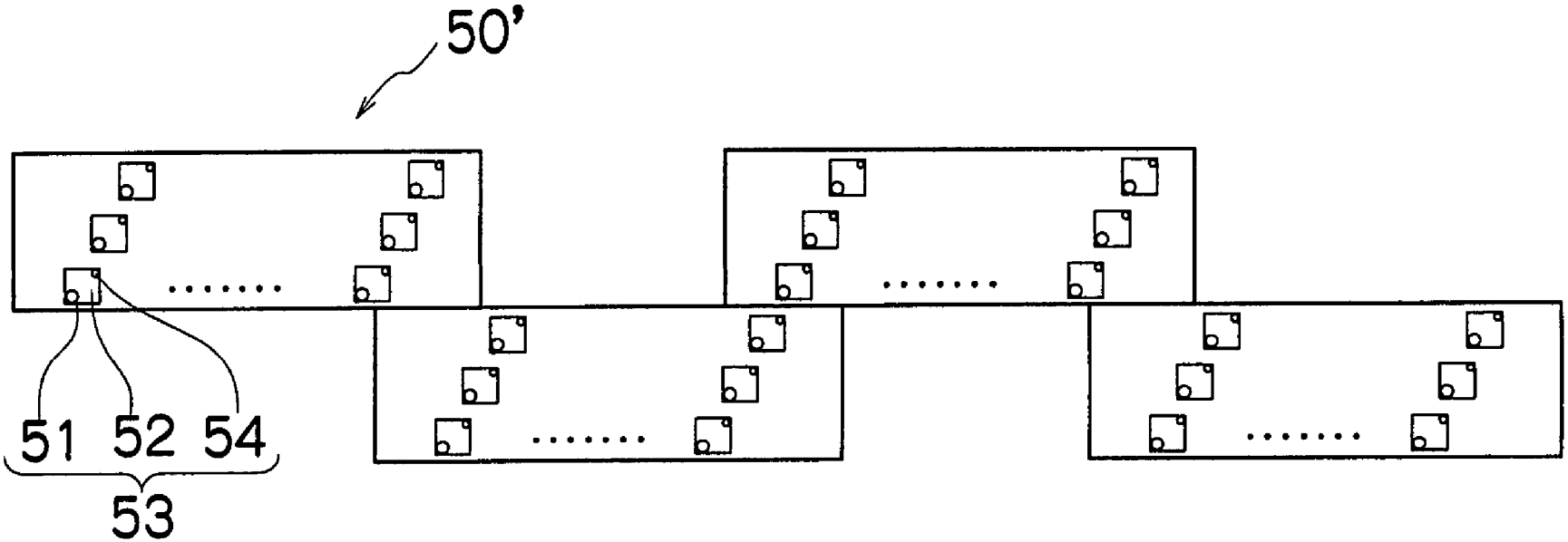
FIG. 3C is a perspective plan view showing another example of the configuration of the print head.
Figure 4:
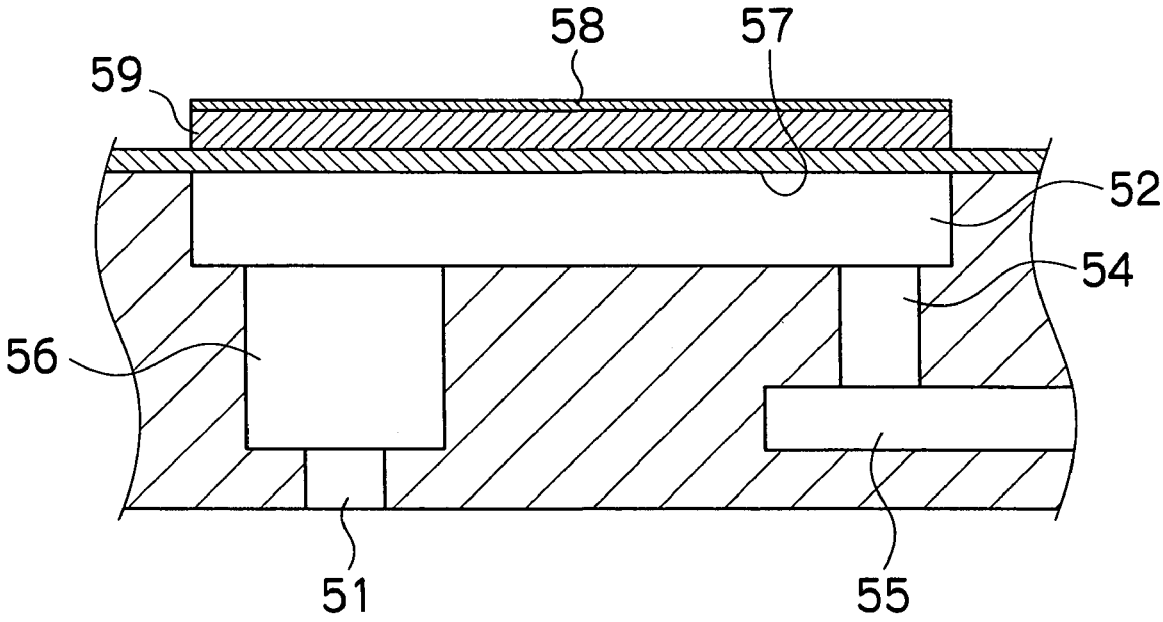
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

As shown in FIGS. 3A to 3C, the planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel 55 through the supply port 54. The common channel 55 is connected to an ink supply tank 60 (not shown in FIG. 4, but shown in FIG. 6), which is a base tank that supplies ink, and the ink supplied from the ink supply tank 60 is delivered through the common flow channel 55 to the pressure chamber 52.

As shown in FIG. 4, the nozzle 51 is connecting to the pressure chamber 52 through a nozzle channel 56. An actuator 59 having a discrete electrode 58 is joined to a pressure plate 57, which forms the ceiling of the pressure chamber 52, and the actuator 59 is deformed by applying drive voltage to the discrete electrode 58 to eject ink from the nozzle 51. When ink is ejected, new ink is delivered from the common flow channel 55 through the supply port 54 to the pressure chamber 52.

Figure 5:
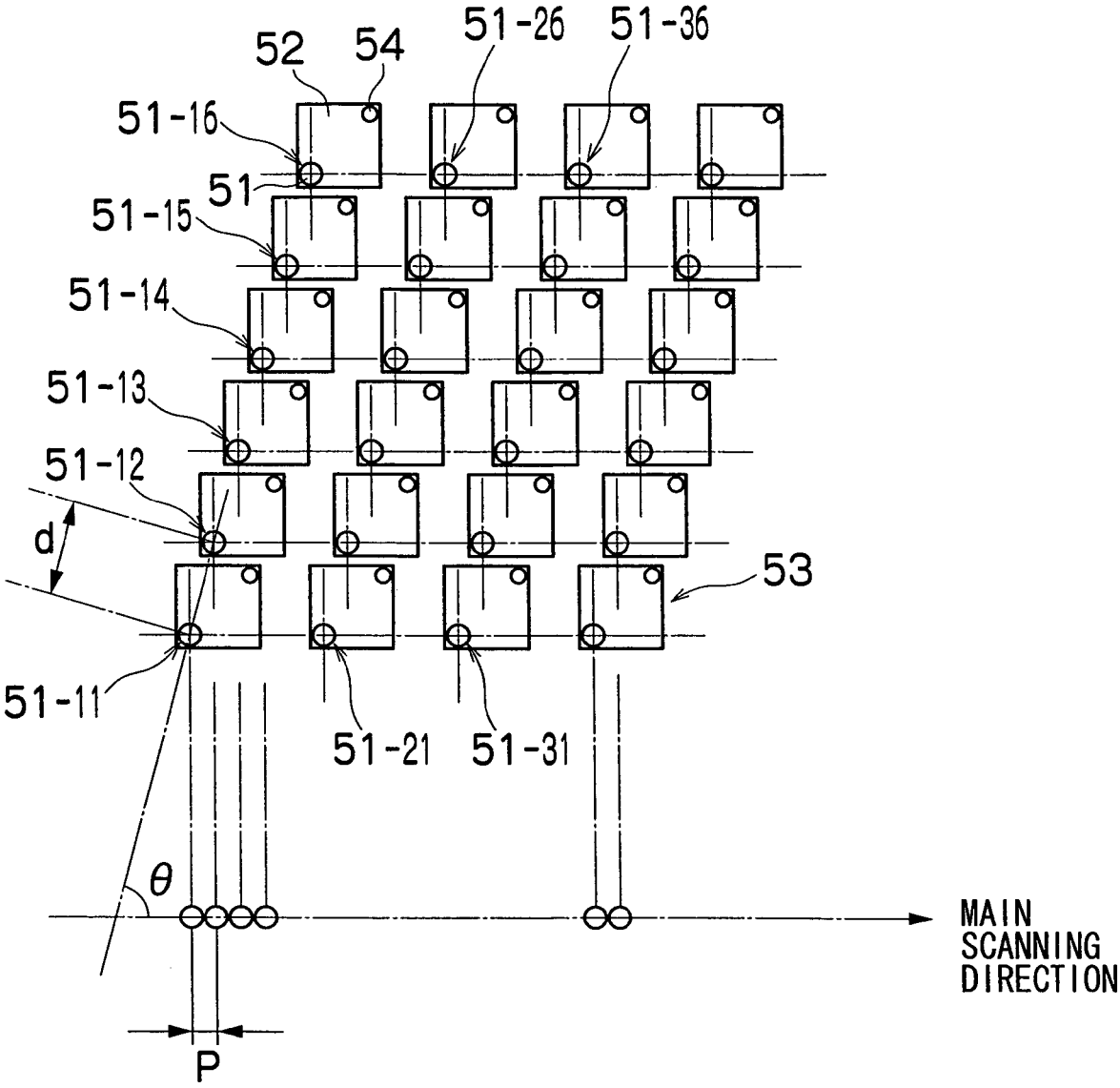
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is d×cos θ.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 59, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 6:
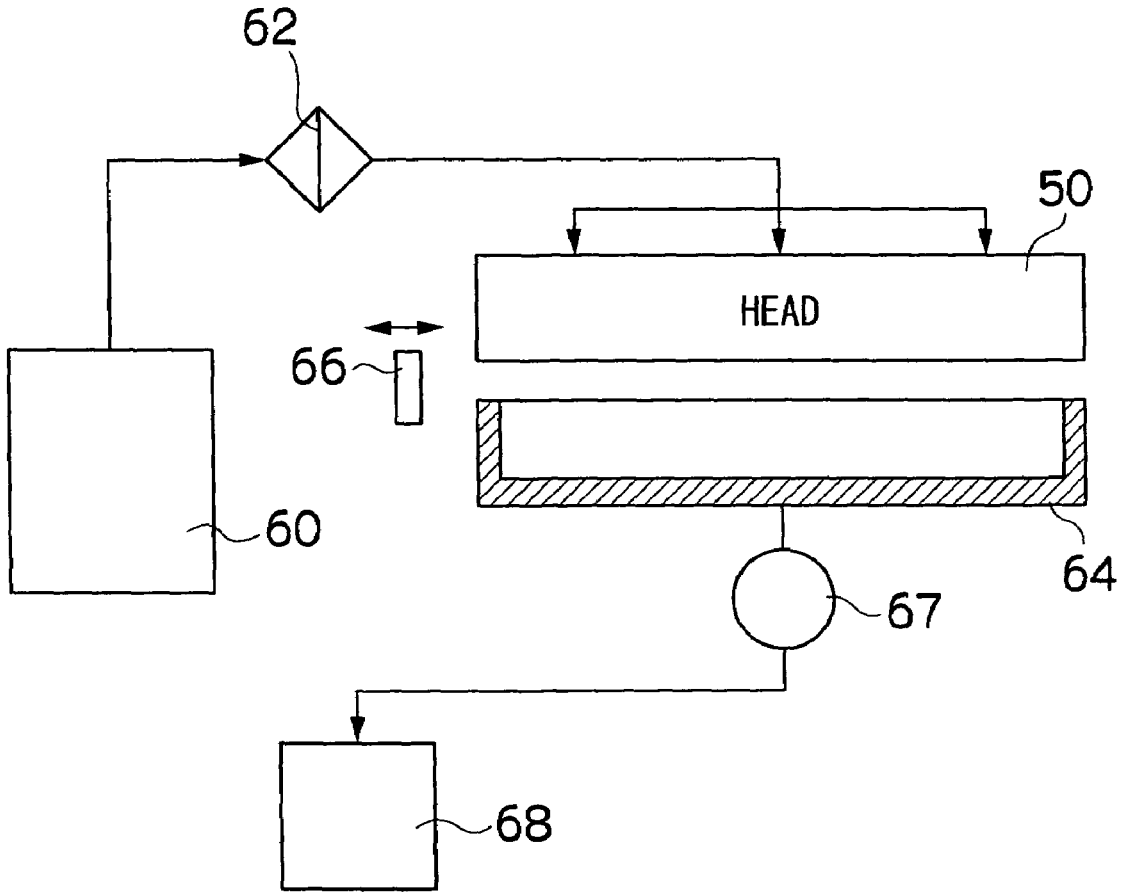
FIG. 6 is a schematic drawing showing a configuration of an ink supply system in the inkjet recording apparatus.

FIG. 6 is a schematic drawing showing the configuration of the ink supply system in the inkjet recording apparatus 10. An ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 59 is operated. Before reaching such a state the actuator 59 is operated (in a viscosity range that allows discharge by the operation of the actuator 59), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 59 is operated. Also, when the ink viscosity inside the nozzle 51 has increased over a certain level, ink can no longer be discharged from the nozzle 51 even if the actuator 59 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

The cap 64 described with reference to FIG. 6 serves as the suctioning device and also as the ink receptacle for the preliminary discharge.

Description of Control System

Figure 7:
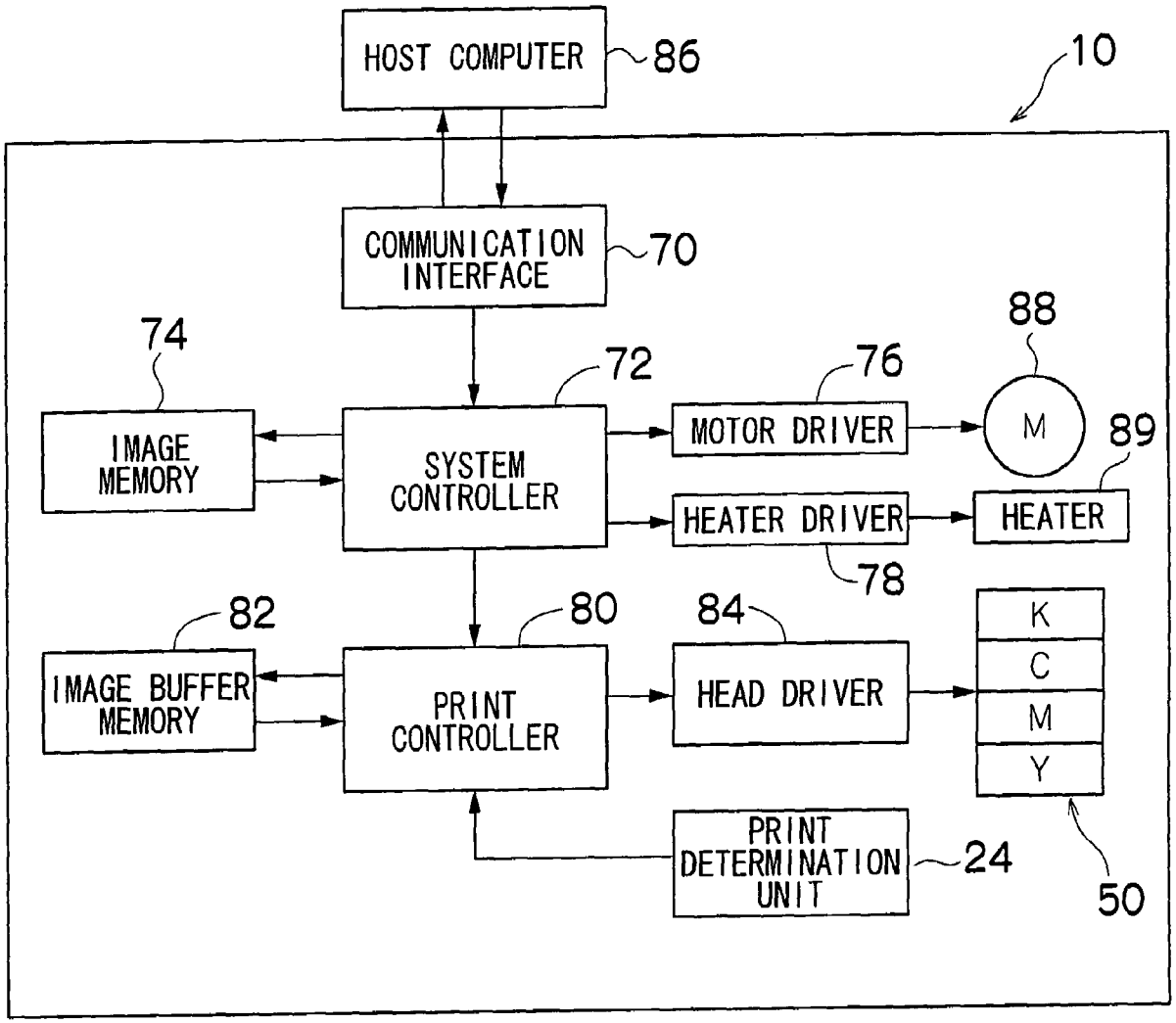
FIG. 7 is a principal block diagram showing the system composition of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefore, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (image formation data) to the head driver 84.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print control unit 80, and the discharge amount and the discharge timing of the ink droplets or the protective liquid from the respective print heads 50 are controlled via the head drier 84, on the basis of the image data. By this means, prescribed dot size, dot positions, or coating of protective liquid can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 59 for the print heads 12K, 12C, 12M and 12Y of the respective colors on the basis of the print data received from the print controller 80. A feedback control system for keeping the drive conditions for the print heads constant may be included in the head driver 84.

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80. The read start timing for the line sensor is determined from the distance between the line sensor and the nozzles and the conveyance velocity of the recording paper 16.

The print controller 80 makes various compensation with respect to the print head 50 as required on the basis of the information obtained from the print determination unit 24.

Structure of the Pressure Chamber

The print head 50 according to the embodiment of the present invention is configured to satisfy conditions for preventing bubbles from remaining inside the pressure chamber 52. The conditions for preventing residual bubbles are examined below by referring to the reference drawings in FIGS. 8A to 9, with consideration given to the causes that generate residual bubbles in the pressure chamber.

Figure 8A:
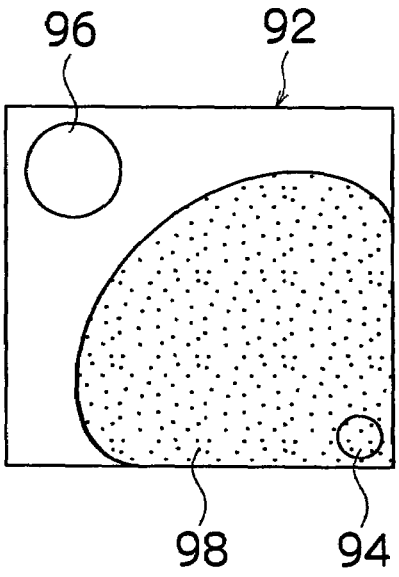
FIGS. 8A and 8B are reference drawings used for examining the cause of residual bubbles in the pressure chamber.
Figure 8B:
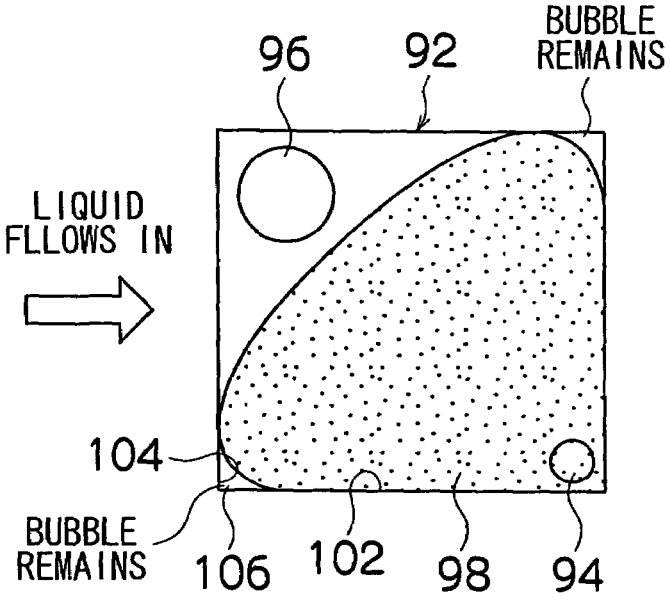

FIGS. 8A and 8B are plan views of a pressure chamber 92 viewed from the actuator (piezoelement) side. In FIGS. 8A and 8B, the reference numeral 94 designates a supply side opening, and the reference numeral 96 designates a discharge side opening in communication with a nozzle flow channel. When ink 98 is supplied from the supply side opening 94 to the interior of the pressure chamber 92, the state in FIG. 8A gradually transitions to the state in FIG. 8B as the ink 98 flows therein.

As shown in FIGS. 8A and 8B, when the planar shape of the pressure chamber 92 is square, there are cases in which a bubble 106 remains in a corner portion 104 of the pressure chamber 92 due to the contact angle of the ink 98 on a side surface 102 inside the pressure chamber 92 when the ink 98 flows from the supply side opening 94 into the pressure chamber 92. Here, for descriptive convenience, the contact angles of the ink 98 on the top surface (pressurization plate side) and the bottom surface (nozzle plate side) of the pressure chamber 92 are ignored.

Figure 9:
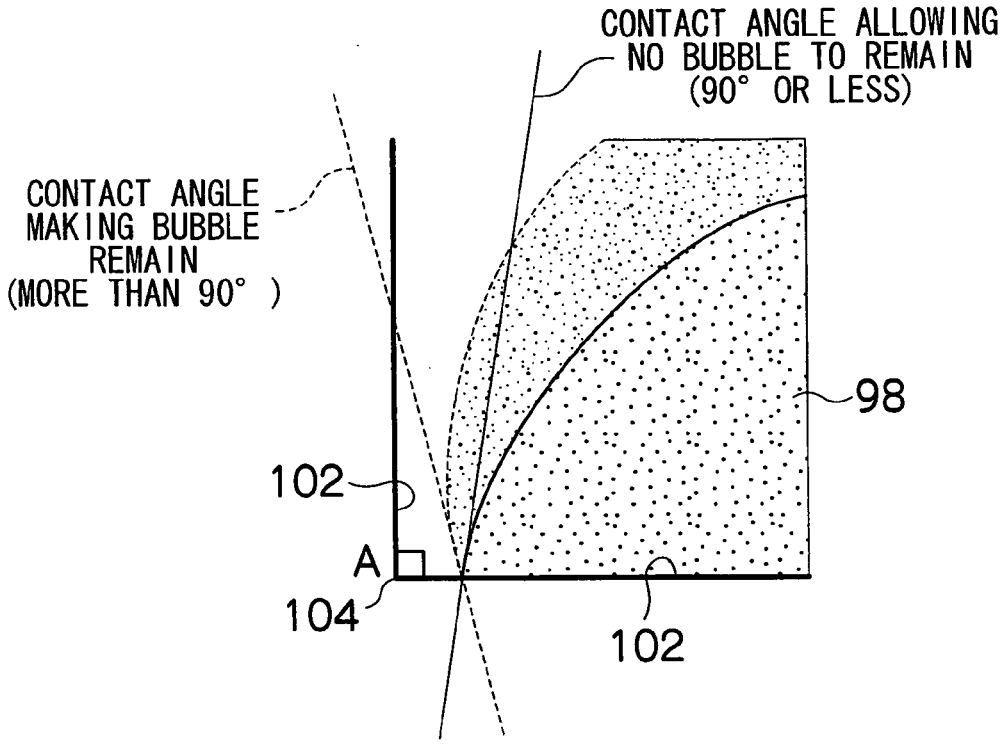
FIG. 9 is a schematic diagram showing the relationship between the contact angle of the ink on the inner surface of the pressure chamber and the angle of a corner portion of the pressure chamber.

As shown in FIG. 9, when the angle is 90° in the corner portion 104 where two mutually adjacent side surfaces 102 intersect with each other to form the pressure chamber 92, ink 98 makes contact with the next side surface 102 before making contact with the apex A of the corner portion 104 when the contact angle of the ink 98 on the side surface 102 is greater than 90°, so that a bubble will remain in the corner portion 104.

On the other hand, if the contact angle is 90° or less, ink 98 first makes contact with the apex A of the corner portion 104, so that no bubble remains in the corner portion 104.

Figure 10A:
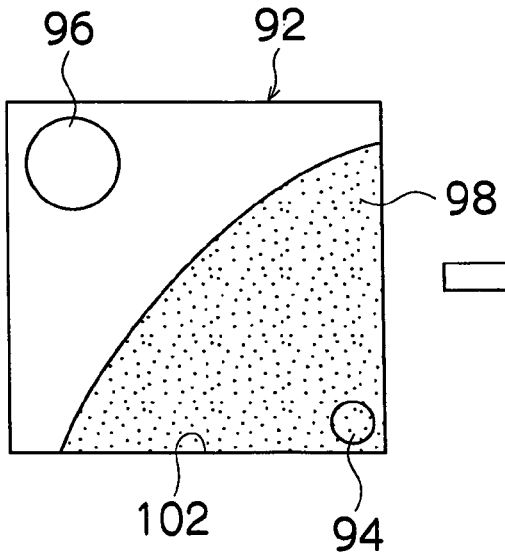
FIGS. 10A and 10B are plan views showing the state in which ink is filled under conditions in which no bubble remains in the pressure chamber.
Figure 10B:
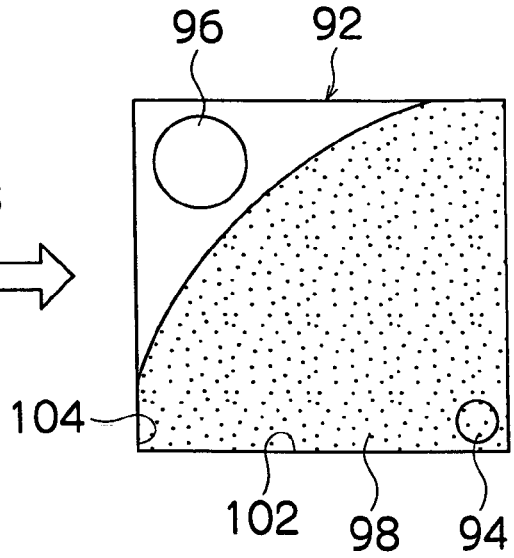

Therefore, as shown in FIGS. 10A and 10B, the side surface 102 of the pressure chamber 92 is preferably configured so that the contact angle of the ink 98 on the side surface 102 during ink inflow is 90° or less. In accordance with this aspect, when ink 98 flows from the supply side opening 94 into the interior of the pressure chamber 92, the state in FIG. 10A gradually transitions to the state in FIG. 10B as the ink 98 flows therein, and no bubble remains in the corner 104 of the pressure chamber 92.

Figure 11:
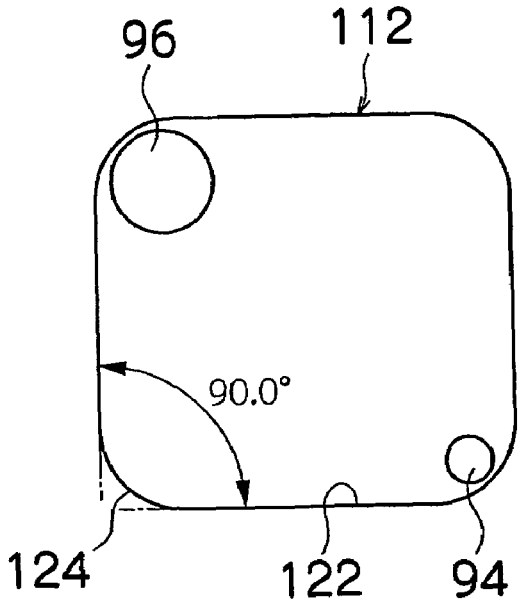
FIG. 11 is a plan view showing an example of the shape of the pressure chamber in which the corners are chamfered in arcuate form.

The same applies to the configuration in a pressure chamber 112 shown in FIG. 11, in which the angle formed by two adjacent side surfaces 122 is 90°, a corner portion 124 is chamfered in arcuate form, and the condition of the contact angle whereby no bubble remains is 90° or less.

Figure 12:
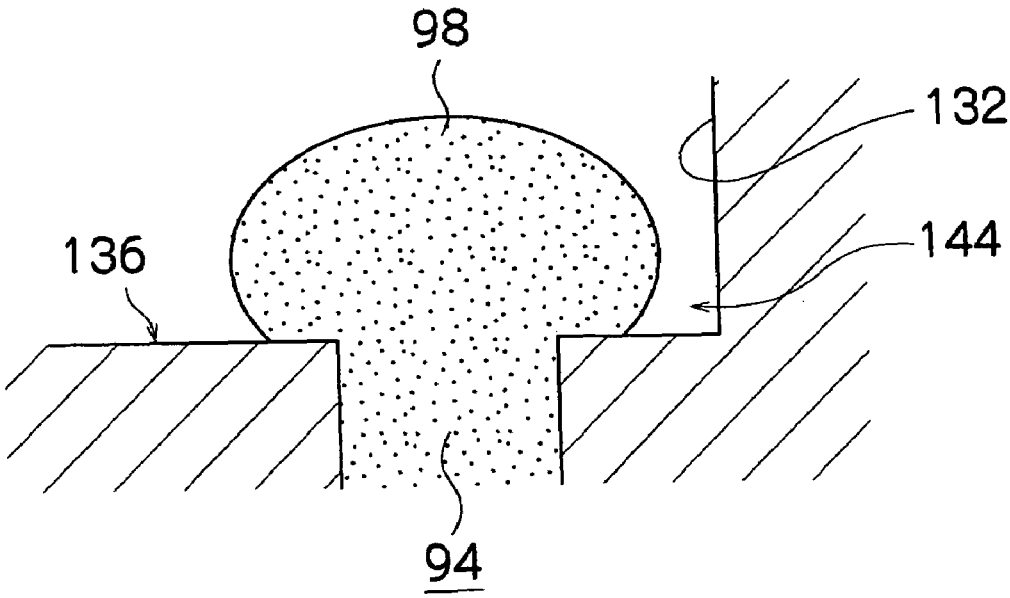
FIG. 12 is an enlarged cross-sectional view of the vicinity of the aperture on the supply side of the pressure chamber when ink is filled under conditions in which bubbles remain.
Figure 13:
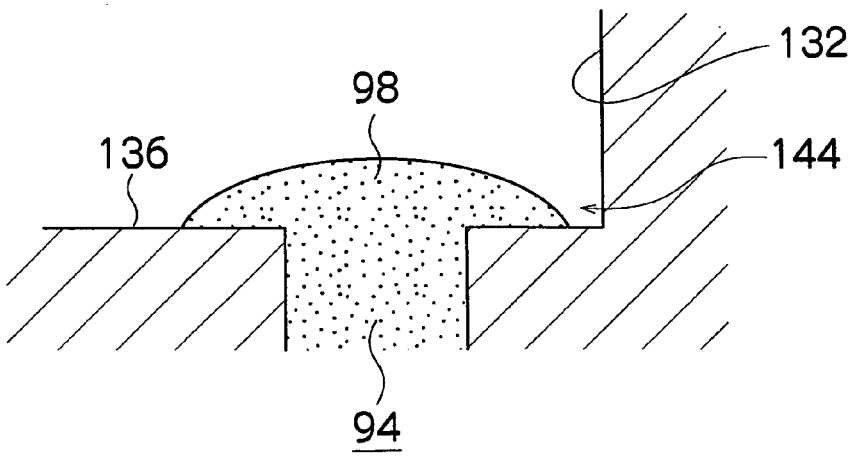
FIG. 13 is an enlarged cross-sectional view of the vicinity of the aperture on the supply side of the pressure chamber when ink is filled under conditions in which no bubble remains.

The side surfaces of the pressure chamber have been described in FIGS. 8A to 11, but the same can be said, as shown in FIGS. 12 and 13, for a corner portion 144 formed by a side surface 132 and a bottom surface 136 of the pressure chamber, or the corner portion formed by the side surface 132 and the upper portion (not shown).

Shown in FIGS. 12 and 13 are states in which ink 98 begins to flow into the pressure chamber from the supply side opening 94 formed in the bottom surface 136 of the pressure chamber. In other words, when the angle of the corner portion 144 formed by the side surface 132 and the bottom surface 136 is 90° as shown in FIG. 12, a bubble will remain in the corner portion 144 when the contact angle of the ink 98 on the bottom surface 136 is greater than 90°.

In contrast, no bubble remains in the corner portion 144 when the contact angle of the ink 98 on the bottom surface 136 is 90° or less as shown in FIG. 13.

Next, the case in which the planar shape of the pressure chamber is hexagonal is examined.

Figure 14A:
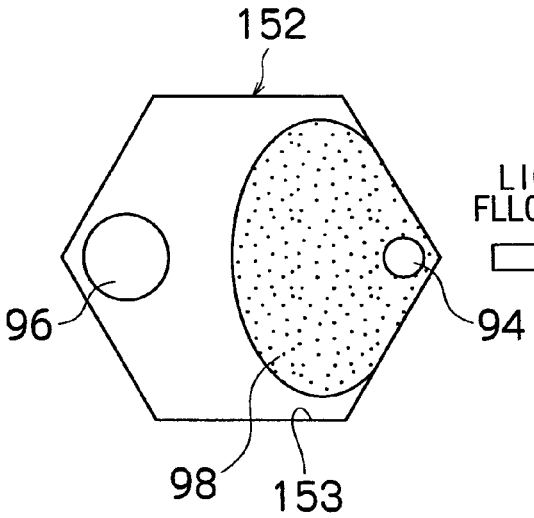
FIGS. 14A and 14B are plan views showing the state in which ink is filled under conditions in which bubbles remain in a pressure chamber with a hexagonal planar shape.
Figure 14B:
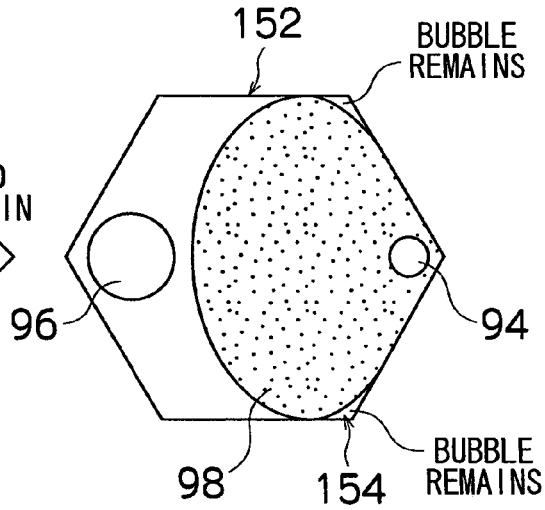

As shown in FIG. 14A, a supply side opening 94 is formed in the area of one of the corners (corner portion) in a pressure chamber 152 with a substantially orthohexagonal shape, and a discharge side opening 96 is formed in the vicinity of the facing corner. When ink 98 flows from the supply side opening 94 into a pressure chamber 152, the state in FIG. 14A gradually transitions to the state in FIG. 14B. In other words, a bubble will remain in a corner portion 154 when the contact angle of the ink 98 on a side surface 153 of the pressure chamber 152 is greater than 120°, as shown in FIGS. 14A and 14B.

Figure 15A:
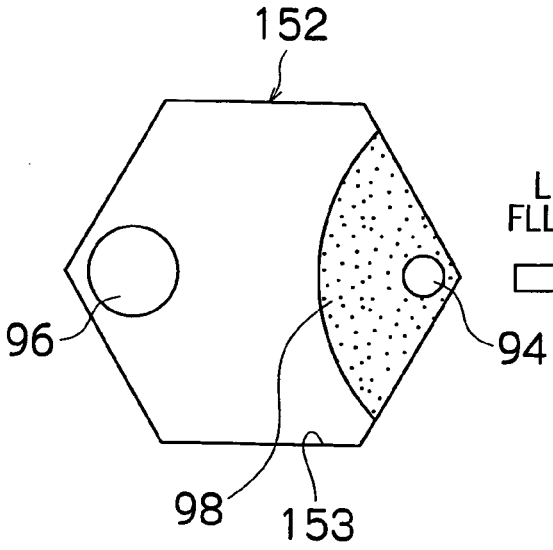
FIGS. 15A and 15B are plan views showing the state in which ink is filled under conditions in which no bubble remains in the pressure chamber with the hexagonal planar shape.
Figure 15B:
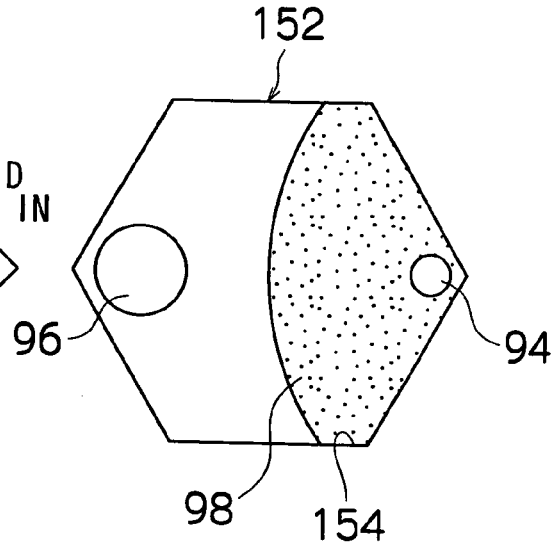

In contrast, if the contact angle of the ink 98 on the side surface 153 is 120° or less as shown in FIGS. 15A and 15B, no bubble remains in the corner portion 154.

Figure 16:
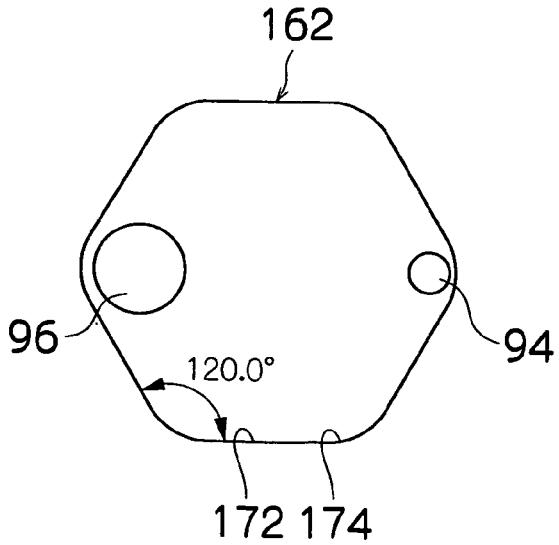
FIG. 16 is a plan view showing an example of the shape of the pressure chamber in which the corners are chamfered in arcuate form.

The same applies to the configuration in a pressure chamber 162 with a substantially orthohexagonal shape shown in FIG. 16, in which the angle formed by two mutually adjacent side surfaces 172 is 120°, a corner portion 174 is chamfered in arcuate form, and the condition of the contact angle of the ink on the side surface 172 whereby no bubbles remains in the corner portion 174 is 120° or less.

Next, the case in which the pressure chamber has another polygonal shape is examined.

Figure 17A:
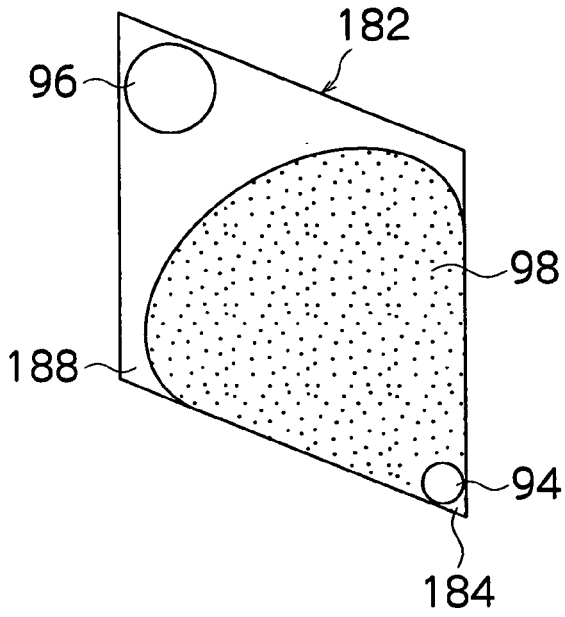
FIGS. 17A and 17B are plan views showing another example of the shape of the pressure chamber.
Figure 17B:
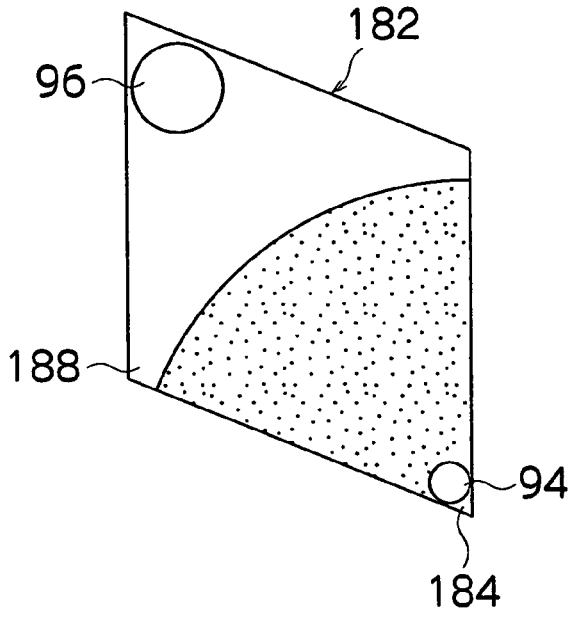

As shown in FIGS. 17A and 17B, a pressure chamber 182 has the shape of a parallelogram, a supply side opening 94 is formed in one of the acute corner portions 184, and a discharge side opening 96 is formed in the other. Bubbles will remain in the obtuse corner portions 188 in FIG. 17A when ink 98 flows from the supply side opening 94, whereas no bubble remains in the obtuse corner portions 188 in FIG. 17B. In other words, bubbles will not remain if the contact angle of the ink 98 is equal to or less than the angle of the obtuse corner portions 188.

Figure 18A:
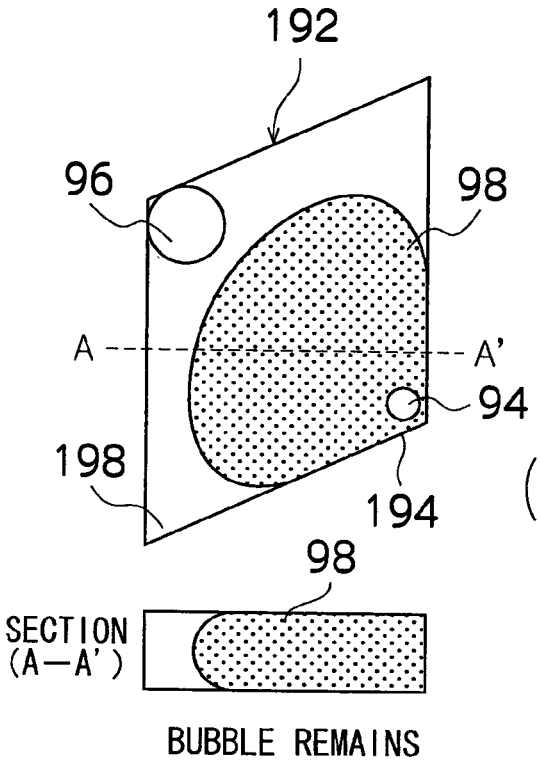
FIGS. 18A and 18B are plan views and sectional views showing another example of the shape of the pressure chamber.
Figure 18B:
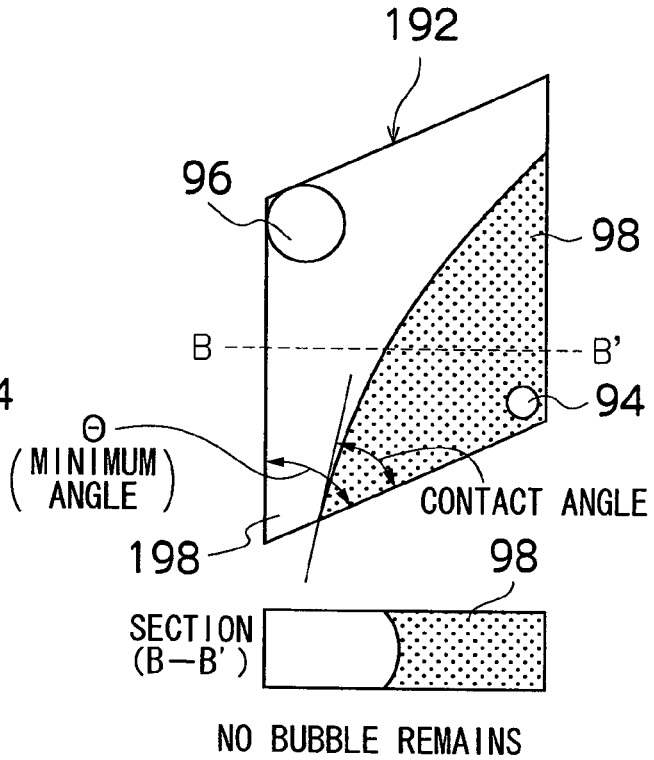

As shown in FIGS. 18A and 18B, a pressure chamber 192 has the shape of a parallelogram, a supply side opening 94 is formed in one of the obtuse corner portions 194, and a discharge side opening 96 is formed in the other. Bubbles will remain in the acute corner portions 198 in FIG. 18A when ink 98 flows form the supply side opening 94, whereas no bubble remains the acute corner portions 198 in FIG. 18B. In other words, bubbles will not remain if the contact angle of the ink 98 is equal to or less than the angle of the acute corner portions 198.

In light of the above, when the angle formed inside the pressure chamber by mutually adjacent surfaces constituting the inner surfaces of the pressure chamber is $\psi$, the condition in which no bubble remains in the corner portions thereof is that the contact angle of the ink on the inner surface be not more than $\psi$.

If the shape of the pressure chamber viewed from the actuator side (piezo side) is polygonal, it is possible that bubbles will remain if the contact angle of the ink is greater than the angle Nk that is the minimum of the angles formed by neighboring surfaces are N1, N2, and so forth. No bubble remains when the contact angle of the ink is equal to or less than Nk.

The relationship between the bottom surface and a side surface (or the top surface and a side surface) of the pressure chamber has been described in FIGS. 12 and 13, but this condition has the most effect when maintained with respect to the side surfaces of the pressure chamber, as described in the other diagrams.

Consequently, the preferable conditions of the inner shape of a three-dimensional pressure chamber for allowing no bubble to remain in the pressure chamber are that the contact angle of the ink on the inner surface of the pressure chamber be not more than the minimum angle $\Theta$ that is the minimum of the angles formed inside the pressure chamber by respective two mutually adjacent surfaces constituting the inner surfaces of the pressure chamber. The conditions are described with reference to FIGS. 18A and 18B. In the pressure chamber 192 shown in FIGS. 18A and 18B, the acute angle corner 198 has the minimum angle $\Theta$, which is the minimum of the angles formed by respective two mutually adjacent surfaces constituting the inner surfaces of the pressure chamber 192. As shown in FIG. 18B, if the contact angle of the ink 98 is equal to or less than the minimum angle Θ, no bubble remains in the pressure chamber 192.

Therefore, the relationship between the type of ink, the shape of the pressure chamber, the surface treatment of the inner surfaces of the pressure chamber, and other factors is selected for the print head 50 of the inkjet recording apparatus 10 described in FIGS. 1 to 7 so as to satisfy the above-described conditions.

Another method is one in which the contact angle of a liquid on the inner surface of the pressure chamber is kept at N degrees that satisfies the above-described conditions (i.e., to be not more than the minimum angle Θ of the pressure chamber) during filling of the liquid by controlling the temperature of the liquid to adjust the contact angle thereof.

Figures 19, 20, 21:
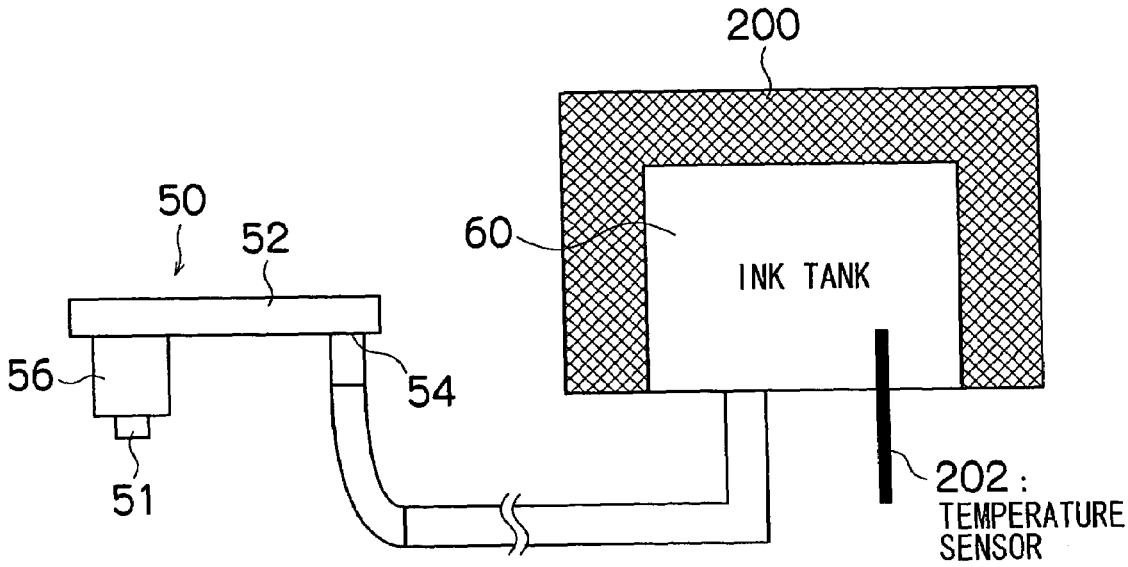
FIG. 19 is a table indicating the surface tension of water at various temperatures.
FIG. 20 is a table indicating contact angles of water on PTFE (polytetrafluoroethylene)
FIG. 21 is a schematic diagram showing a placement example of the heating device for adjusting the temperature.

The relationship between the temperature and surface tension of water is shown in FIG. 19. As shown in the table in FIG. 19, the surface tension of water decreases with increased temperature (refer to Rika Nenpyo, published by the National Astronomical Observatory of Japan for a detailed explanation). The contact angle also decreases as the surface tension decreases. For example, the contact angle of water on PTFE (polytetrafluoroethylene) varies with the temperature as shown in FIG. 20.

The surface tension of the liquid commonly decreases as its temperature increases, and the contact angle also decreases therewith. The water-soluble ink used in the inkjet recording apparatus 10 of the present embodiment also has the same characteristics (i.e., the surface tension and the contact angle decrease as the temperature increases). For this reason, the contact angle can be adjusted by controlling the temperature of the ink or the flow channel (more specifically, the flow channel's inner surface in contact with the ink). However, the extent of the variation of the contact angle differs according to the characteristics of each liquid, the material of the contact inner surface, and other factors, so design must be carried out in accordance with conditions.

By applying heat to ink during filling so that the temperature of the ink is adjusted to make the contact angle of the ink satisfy the above conditions, it is possible to fill the ink without residual bubbles in the pressure chamber.

FIGS. 21 to 24 show placement examples of the heating device for adjusting the temperature.

In the example shown in FIG. 21, a heater 200 is arranged on the ink tank 60 for supplying ink to the pressure chamber 52. The ink tank 60 is provided with a temperature sensor 202 as a device for measuring the temperature. The temperature sensor 202 is used to control the heater 200 as it regulates the ink temperature.

Figure 22:
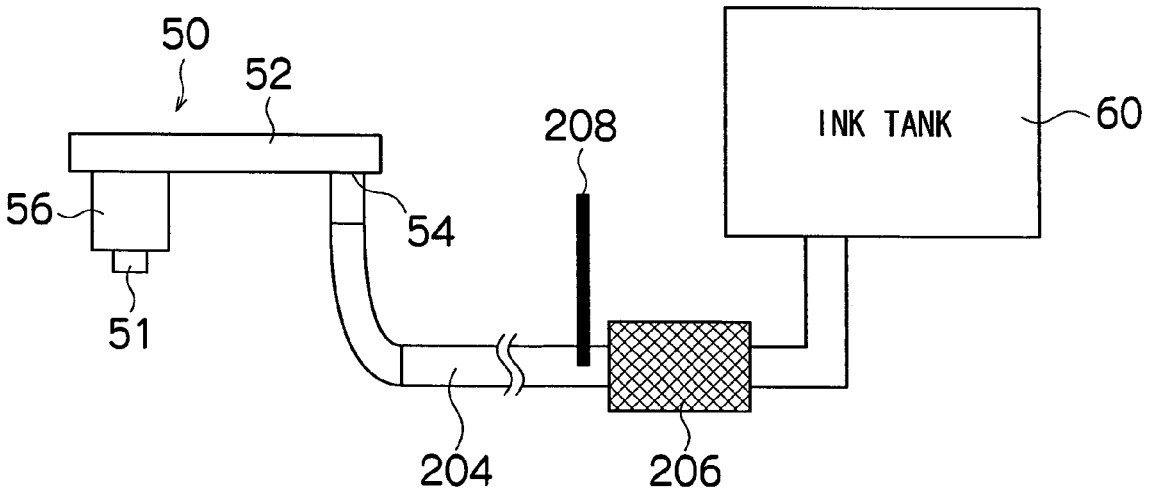
FIG. 22 is a schematic diagram showing another placement example of the heating device for adjusting the temperature.

In the example shown in FIG. 22, a heater 206 is arranged midway in a conduit 204 that connects the print head 50 and the ink tank 60. The temperature sensor 208 is disposed in a suitable position in the conduit 204 between the heater 206 and the supply side opening 94.

Figure 23:
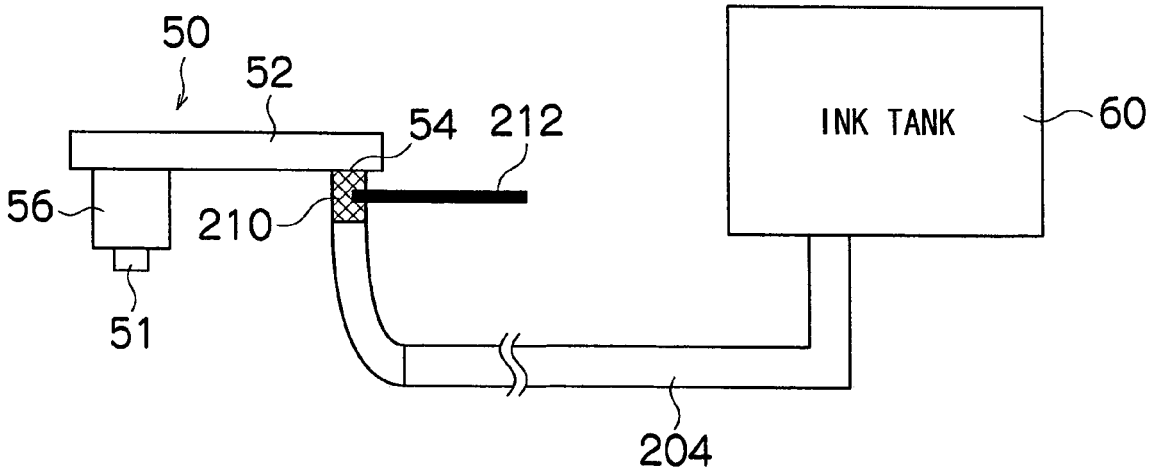
FIG. 23 is a schematic diagram showing another placement example of the heating device for adjusting the temperature.

In the example shown in FIG. 23, a heater 210 is arranged inside the print head 50. The heater 210 and a temperature sensor 212 are arranged in the vicinity of the supply side opening 94, and the configuration is such that ink is heated just prior to entering the pressure chamber 52.

Figure 24:
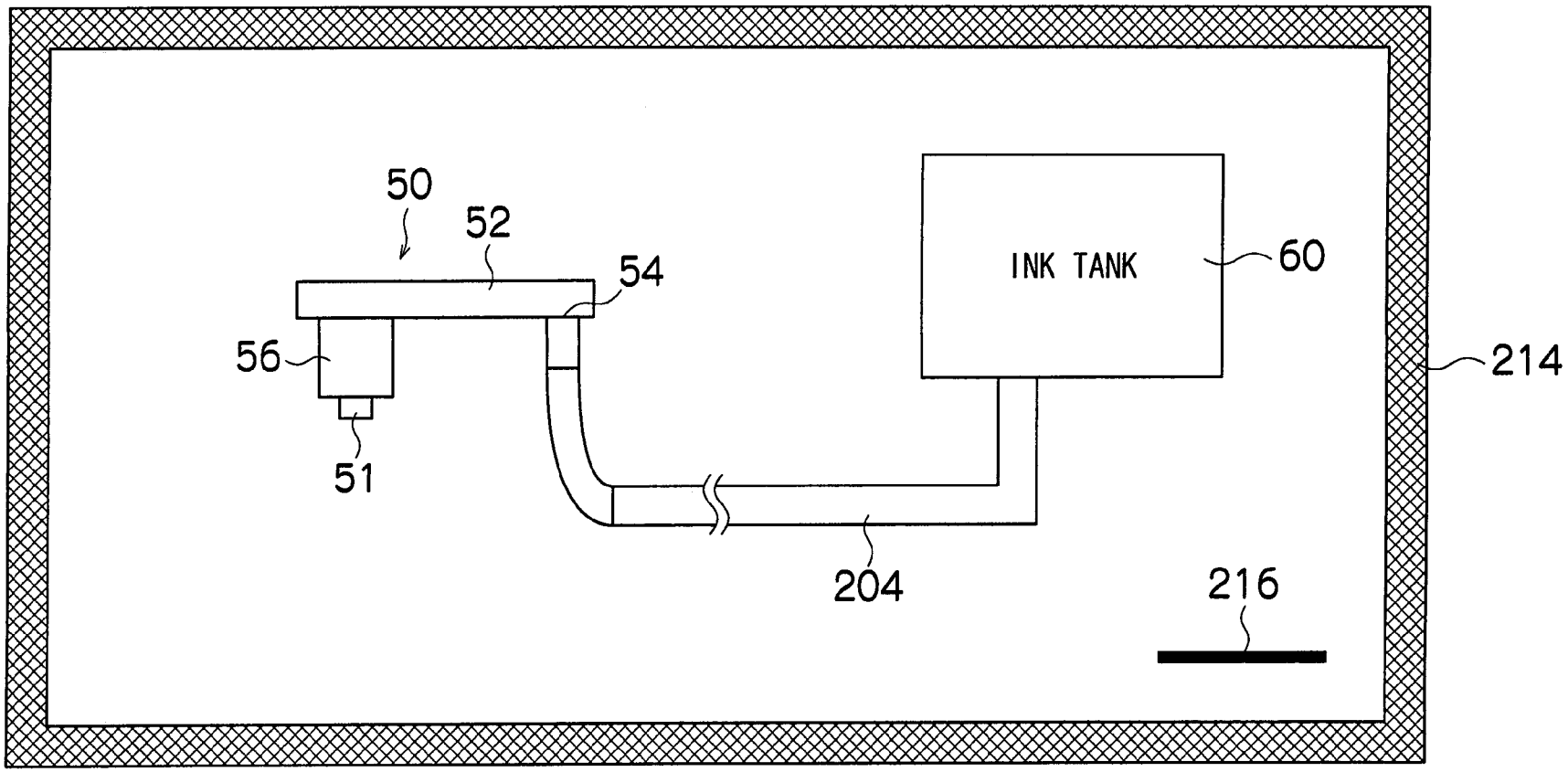
FIG. 24 is a schematic diagram showing another placement example of the heating device when adjusting the temperature.

As shown in FIG. 24, also possible is an aspect in which a heater 214 is arranged so as to enclose the entire print head 50 and ink tank 60, and the entire print head 50 and ink tank 60 are heated during ink filling. In this case, a temperature sensor 216 is disposed in a suitable position in the area enclosed by the heater 214.

Any one of the aspects described in FIGS. 21 to 24 is possible, but even more preferable is an appropriate combination of a plurality of these aspects that results in a reduced temperature variation.

Distribution of Liquid-Philization Treatment Inside the Pressure Chamber

The pressure chamber is designed so as to produce a required contact angle of the ink in accordance with the shape (principally the angle of the corner portion) of the pressure chamber in order to have the ink advancement during ink filling in a way that inhibits residual bubbles inside the pressure chamber.

A possible aspect is one in which ink is led predominantly to corner portions, where residual bubbles are easily formed, by providing nonuniformity to the contact angles of the ink on the respective inner surfaces (ceiling surface (top surface), side surfaces, floor surface (bottom surface) of the pressure chamber) by patterning the inner surfaces with a liquid-philization treatment to impart the liquid-philic properties to the surface. One example is an aspect in which the liquid-philization treatment is performed solely in the vicinity of the side surfaces inside the pressure chamber, where bubbles tend to remain during ink filling.

In the present specification, the term "liquid-philic" means "having a strong affinity for the liquid (i.e., for the ink, in the present embodiment)". For example, in the case where the liquid or the ink is an aqueous solution or water-based, the terms "liquid-philic", "liquid-philicity", "liquid-philize" and "liquid-philization" correspond to "hydrophilic", "hydrophilicity", "hydrophilize" and "hydrophilization", respectively; and the antonymous term "liquid-phobic" and its derivatives correspond to "hydrophobic" and its derivatives. On the other hand, in the case where the liquid or the ink is an oleaginous solution or oil-based, the term "liquid-philic" and its derivatives correspond to "oleophilic" and its derivatives; and the term "liquid-phobic" and its derivatives correspond to "oleophobic" and its derivatives.

Specific examples of patterning with the liquid-philization treatment are described below.

Figure 25:
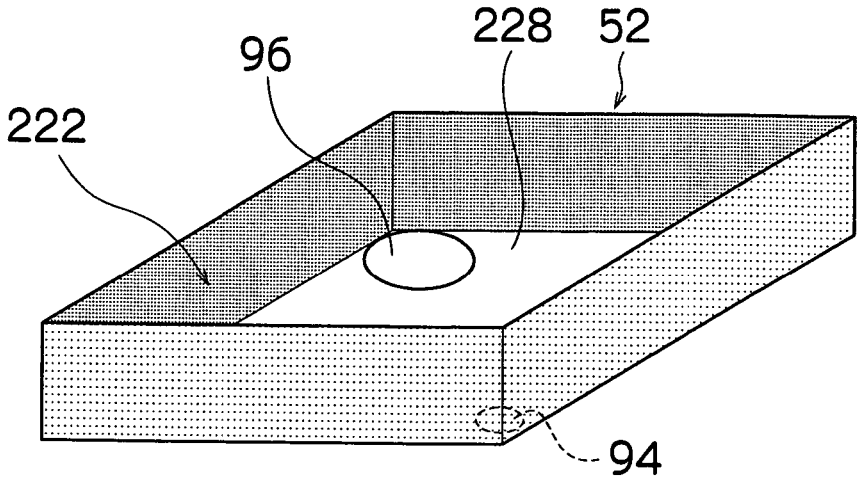
FIG. 25 is a perspective view showing an example of side surfaces of the pressure chamber have been subjected to the liquid-philization treatment.

FIG. 25 shows an example in which solely the entire side surface 222 (entire circumference) of the pressure chamber 52 is subjected to the liquid-philization treatment, and the top surface (not shown) and the bottom surface 228 are left untreated. Examples of surface treatments that may be used to liquid-philization (to enhance affinity for the liquid, or to impart liquid-philic properties) include acid treatment, alkali treatment, plasma treatment, corona discharge treatment, dye-adsorbing layer formation, metal plating, and oxide treatment. Also included is an aspect in which the surface is roughened (minute irregularities are formed on the surface to produce a roughened surface) as a method of liquid-philization treatment. A suitable treatment is selected with consideration for the type of ink, the shape of the pressure chamber, and other factors.

Figure 26:
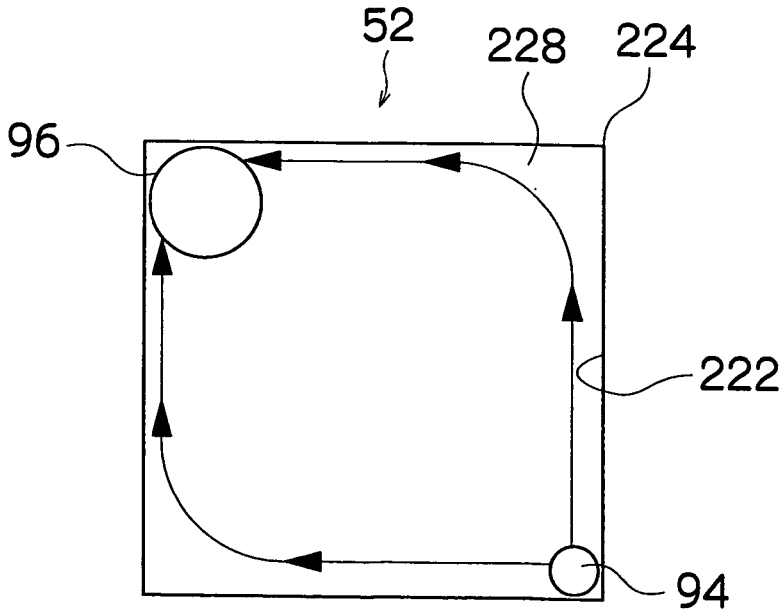
FIG. 26 is a plan view showing the flow of ink during filling in the pressure chamber in FIG. 25.

In accordance with this configuration, ink that flows from the supply side opening 94 goes along the side surface 222 toward the discharge side opening 96 as shown in FIG. 26, so bubbles are inhibited from remaining in the corner portions 224.

Figure 27A:
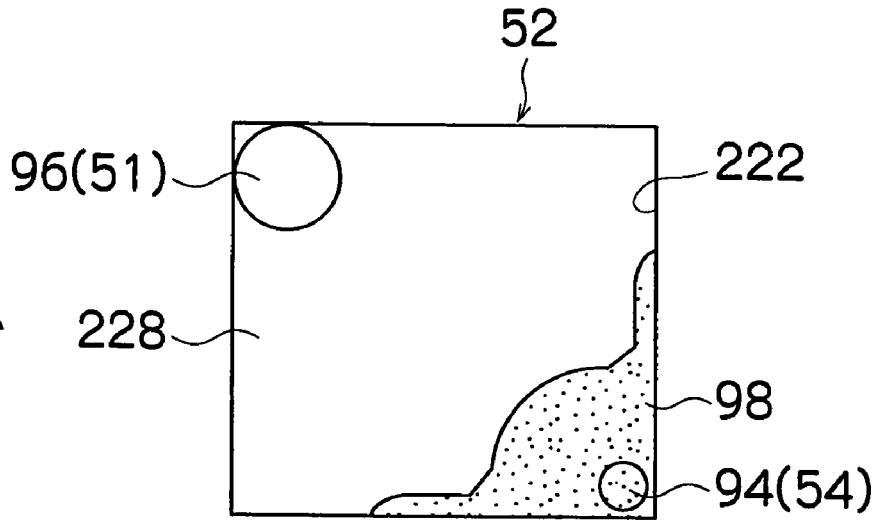
FIGS. 27A to 27C are plan views showing the manner in which ink flows during filling in the pressure chamber in FIG. 25.
Figure 27B:
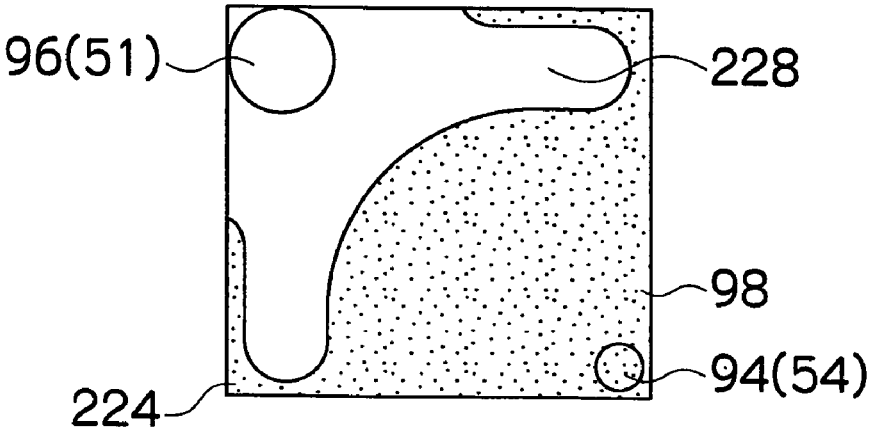
Figure 27C:
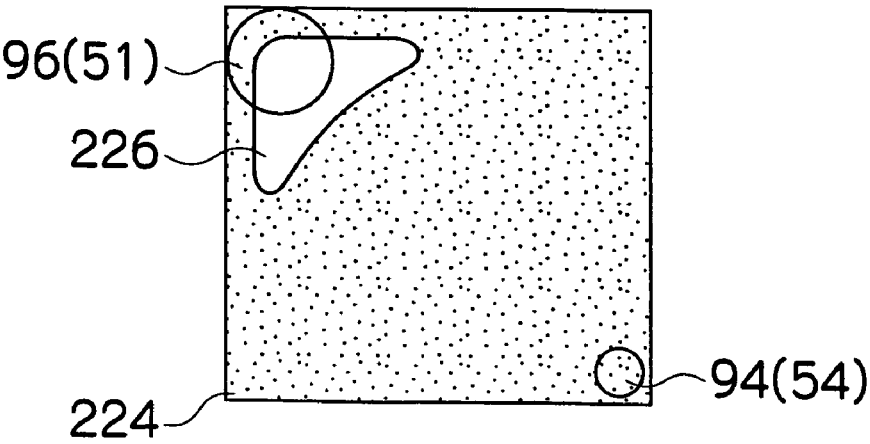

FIGS. 27A to 27C are schematic diagrams showing the manner in which ink 98 flows when solely the side surfaces 222 of the pressure chamber 52 are subjected to liquid-philization treatment. When the ink 98 flows from the supply side opening 94, the contact of the ink 98 with the side surface 222 advances ahead due to the liquid-philic properties of the side surface 222, as shown in FIG. 27A. When the ink filling progresses, the ink 98 reaches the corner portion 224 and goes along the side surface 222 as shown in FIG. 27B. In due course, the ink 98 that has advanced along the side surface 222 in the clockwise direction in FIG. 27B, and the ink 98 that has advanced along the side surface 222 in the counterclockwise direction in FIG. 27B meet at the apex nearby the discharge side opening 96 as shown in FIG. 27C.

A bubble 226 that is formed at this time is removed through the discharge side opening 96, preventing residual bubbles from being generated inside the pressure chamber 52.

Thus, by enhancing the liquid-philic properties of the side surface 222 compared to the bottom surface 228 and the top surface (not shown) of the pressure chamber 52, the progress of liquid contact along the side surface 222 can be advanced and bubbles can be prevented from remaining after ink filling.

The distribution pattern of the liquid-philic portions is not limited to the aspect exemplified in FIG. 25. Other liquid-philization treatment patterns are shown in FIGS. 28 to 32C.

Figure 28:
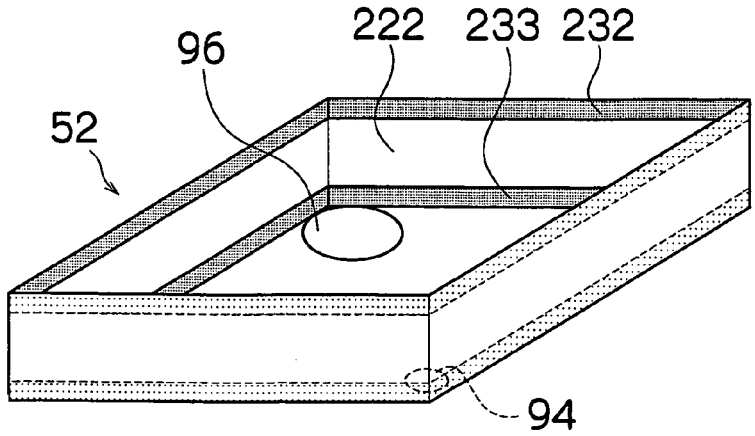
FIG. 28 is a perspective view showing an example of the case in which the edge portions of the side surfaces of the pressure chamber have been subjected to the liquid-philization treatment.

FIG. 28 shows an aspect in which the liquid-philization treatment is carried out on partial areas in the side surface 222 of the pressure chamber 52, more specifically, on a partial area (entire periphery) 232 of the upper side in contact with the top surface (not shown), and on a partial area (entire periphery) 233 of the lower side in contact with the bottom surface 228.

Figure 29:
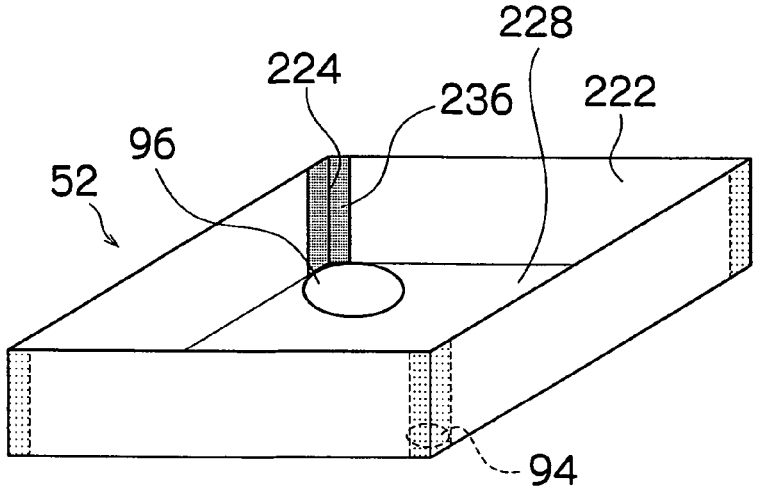
FIG. 29 is a perspective view showing another example of the case in which corner portions of the side surfaces of the pressure chamber have been subjected to the liquid-philization treatment.

FIG. 29 shows an aspect in which the liquid-philization treatment is carried out solely on partial areas 236 in the vicinity of the corner portions 224 formed by mutually adjacent side surfaces 222.

Figure 30:
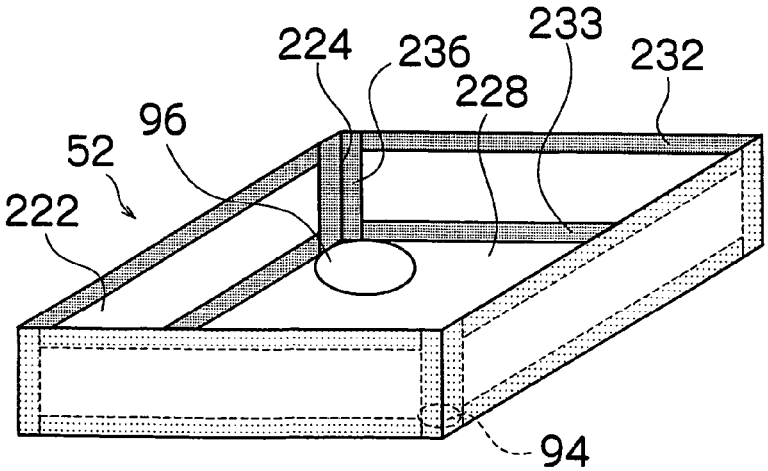
FIG. 30 is a perspective view showing another example of the case in which the edge portions and the corner portions of the side surfaces of the pressure chamber have been subjected to the liquid-philization treatment.

FIG. 30 shows a preferable aspect, which is a combination of the aspects in FIGS. 28 and 29 wherein the liquid-philization treatment is performed on the partial area 232 of the upper side of the side surface 222 and the partial area 233 of the lower side of the side surface 222, as well as the partial areas 236 in the vicinity of the corner portions 224.

Figure 31:
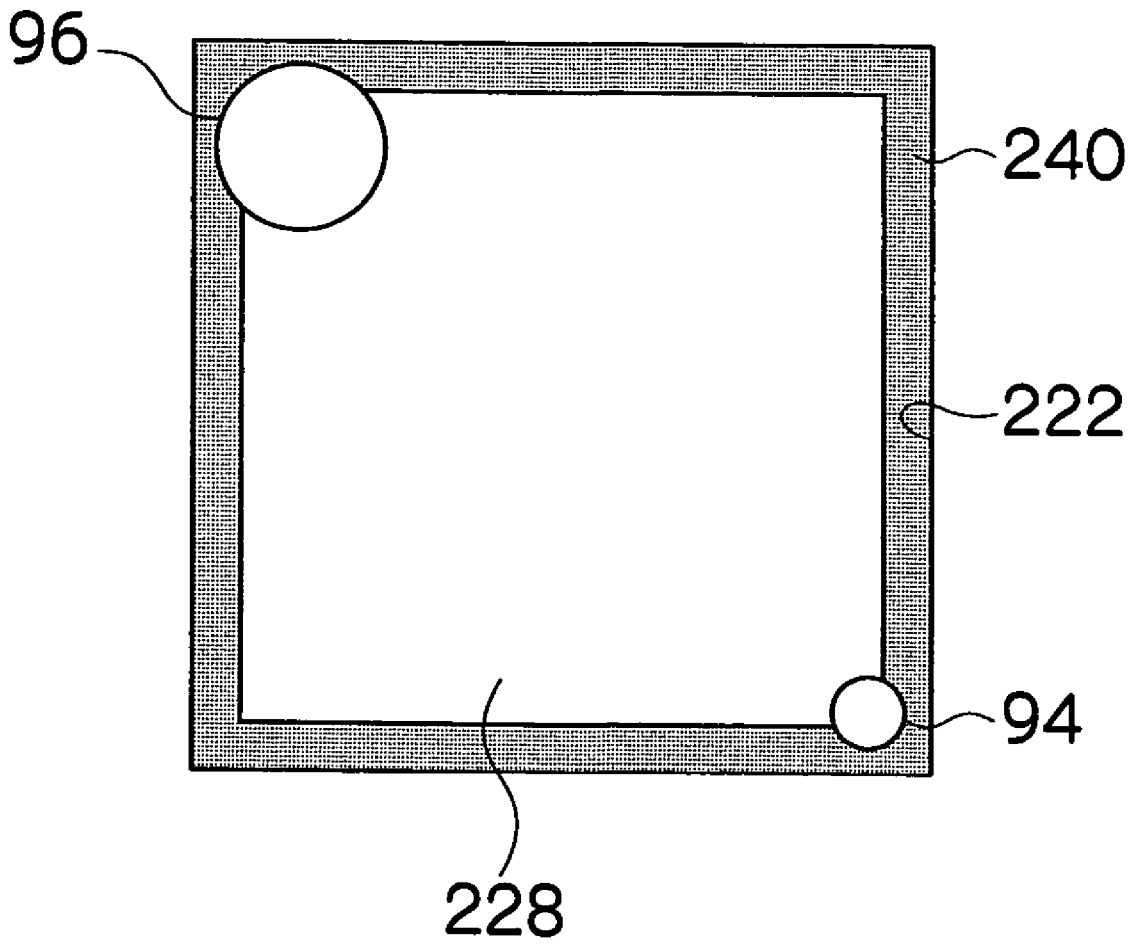
FIG. 31 is a plan view showing an example of the liquid-philization treatment pattern in which the liquid-philization treatment has been performed on portions of the top or bottom inner surface of the pressure chamber.

FIG. 31 shows another preferable aspect in which the liquid-philization treatment is performed on a partial area 240 of the bottom surface 228 and/or the top surface (not shown) of the pressure chamber 52 around the periphery in contact with the side surface 222.

Figure 32C:
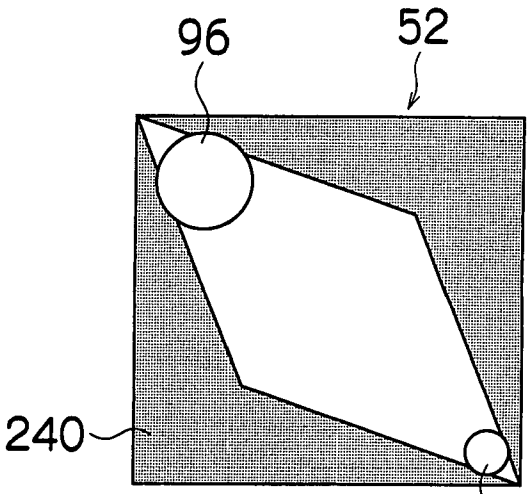
FIGS. 32A to 32C are plan views showing other examples of the liquid-philization treatment pattern in which the liquid-philization treatment has been performed on portions of the top or bottom inner surface of the pressure chamber.
Figure 32B:
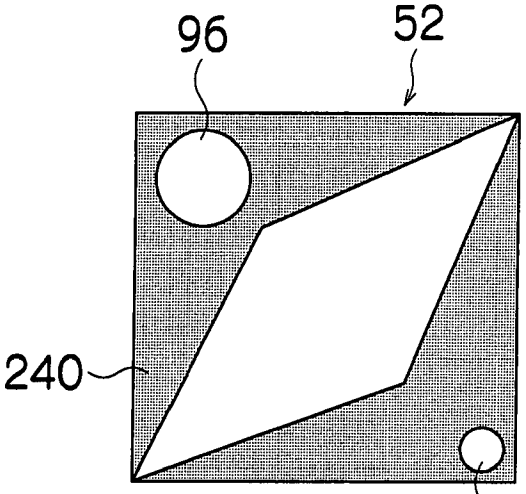
Figure 32A:
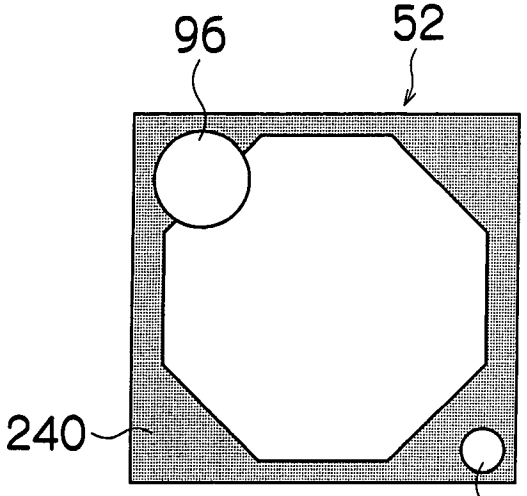

The liquid-philic pattern formed on the upper or bottom surface of the pressure chamber 52, or on both these surfaces may be any of a variety of patterns of the liquid-philic area 240, as shown in FIGS. 32A, 32B and 32C. Effective patterning is selected in accordance with the contact angle of the ink on the surface to be used.

In the above-described embodiments, the liquid-philic portions or patterns are formed by the liquid-philization treatment, and the other portions are not subjected to the liquid-philization treatment; however, the present invention is not limited to this. It is sufficient that the liquid-philic portions have relatively high liquid-philicity than the other portions or the low-liquid-philicity portions, and such condition is also realized by performing the liquid-phobization treatment on the low-liquid-philicity portions and by performing little or no liquid-philization treatment on the liquid-philic portions. It is also possible to perform relatively high liquid-philization treatment on the liquid-philic portions and perform relatively low liquid-philization treatment on the low-liquid-philicity portions.

Described in the above embodiments is an inkjet recording apparatus that uses a page-wide full-line head having a row of nozzles with a length corresponding to the entire width of the recording medium, but the applicable scope of the present invention is not limited to this option alone, and the present invention may also be applied to an inkjet recording device that uses a shuttle head for recording images as the short recording head moves in a reciprocating fashion.

An inkjet recording apparatus has been described as an example of an image formation apparatus, but the range of applicability of the present invention is not limited thereby. For example, the present invention may also be applied to photographic image formation apparatuses for applying developing solution in a non-contact manner to photographic paper. In other words, the present invention can be widely adapted to other image formation devices with a droplet discharging step that is not limited to the application of ink but can also be used to apply a treatment solution, functional solution, or other solution to a medium.

The applicable scope of the present invention is not limited to image formation apparatuses and extends to application apparatuses and various other liquid discharge apparatuses in which a treatment solution or other solution is applied to a medium using a droplet discharging head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet discharging apparatus, comprising:

a nozzle which discharges a droplet of a liquid;

a pressure chamber which is in communication with the nozzle and is fillable with the liquid to be discharged as the droplet through the nozzle;

a pressure generation device which generates pressure variation in the liquid inside the pressure chamber to cause the droplet to be discharged through the nozzle, wherein a contact angle of the liquid on an inner surface of the pressure chamber is not more than an angle formed inside the pressure chamber by two mutually adjacent surfaces constituting the inner surface, wherein the inner surface includes a bottom surface in which a flow port is formed in communication with the nozzle, a top surface which faces the bottom surface, and a side surface which connects the bottom surface and the top surface; and the contact angle of the liquid on the side surface is not more than the angle formed inside the pressure chamber by two mutually adjacent surfaces constituting the inner surface, further comprising a heating device which heats the liquid when the liquid is filled into the pressure chamber so as to adjust the contact angle of the liquid.

2. The droplet discharging apparatus as defined in claim 1, wherein:

the pressure chamber is configured in a substantiality polygonal shape viewed from a droplet discharging direction; and the contact angle of the liquid on the side surface is not more than a minimum of internal angles of the substantially polygonal shape.

3. The droplet discharging apparatus as defined in claim 2, wherein the substantially polygonal shape has more than four sides.

4. An inkjet recording apparatus which performs recording of an image on a recording medium, the apparatus comprising:

an inkjet recording head which includes the droplet discharging apparatus as defined in claim 1 for discharging droplets of ink onto the recording medium; and a conveyance device which conveys at least one of the inkjet recording head and the recording medium relatively to each other during the recording.

5. The droplet discharging apparatus as defined in claim 1, wherein the liquid is ink.

6. A droplet discharging apparatus, comprising:

a nozzle which discharges a droplet of a liquid;

a pressure chamber which is in communication with the nozzle and is fillable with the liquid to be discharged as the droplet through the nozzle; and a pressure generation device which generates pressure variation in the liquid inside the pressure chamber to cause the droplet to be discharged through the nozzle, wherein a contact angle of the liquid on an inner surface of the pressure chamber is not more than an angle formed inside the pressure chamber by two mutually adjacent surfaces constituting the inner surface, wherein the contact angle of the liquid on the inner surface is not more than a minimum of angles formed inside the pressure chamber by respective two mutually adjacent surfaces constituting the inner surface, further comprising a heating device which heats the liquid when the liquid is filled into the pressure chamber so as to adjust the contact angle of the liquid.

7. The droplet discharging apparatus as defined in claim 6, wherein:

the inner surface includes a bottom surface in which a flow port is formed in communication with the nozzle, a top surface which faces the bottom surface, and a side surface which connects the bottom surface and the top surface; and the contact angle of the liquid on the side surface is not more than the minimum angle.

8. The droplet discharging apparatus as defined in claim 7, wherein:

the pressure chamber is configured in a substantially polygonal shape viewed from a droplet discharging direction; and the contact angle of the liquid on the side surface is not more than a minimum of internal angles of the substantially polygonal shape.

9. The droplet discharging apparatus as defined in claim 8, wherein the substantially polygonal shape has more than four sides.

10. The droplet discharging apparatus as defined in claim 6, wherein the liquid is ink.

11. An inkjet recording apparatus which performs recording of an image on a recording medium, the apparatus comprising:

an inkjet recording head which includes the droplet discharging apparatus as defined in claim 6 for discharging droplets of ink onto the recording medium; and a conveyance device which conveys at least one of the inkjet recording head and the recording medium relatively to each other during the recording.

12. A droplet discharging apparatus, comprising:

a nozzle which discharges a droplet of a liquid;

a pressure chamber which is in communication with the nozzle and is fillable with the liquid to be discharged as the droplet through the nozzle; and a pressure generation device which generates pressure variation in the liquid inside the pressure chamber to cause the droplet to be discharged through the nozzle, wherein a contact angle of the liquid on an inner surface of the pressure chamber is not more than an angle formed inside the pressure chamber by two mutually adjacent surfaces constituting the inner surface, further comprising a heating device which heats the liquid when the liquid is filled into the pressure chamber so as to adjust the contact angle of the liquid.

13. The droplet discharging apparatus as defined in claim 12, wherein the liquid is ink.

14. An inkjet recording apparatus which performs recording of an image on a recording medium, the apparatus comprising:

an inkjet recording head which includes the droplet discharging apparatus as defined in claim 12 for discharging droplets of ink onto the recording medium; and a conveyance device which conveys at least one of the inkjet recording head and the recording medium relatively to each other during the recording.

15. A droplet discharging apparatus, comprising:

a nozzle which discharges a droplet of a liquid;

a pressure chamber which is in communication with the nozzle and is filled with the liquid to be discharged as the droplet through the nozzle; and a pressure generation device which generates pressure variation in the liquid inside the pressure chamber to cause the droplet to be discharged through the nozzle, wherein a liquid-philic portion is arranged on an inner surface of the pressure chamber in a first area including a region nearby a corner formed by two mutually adjacent surfaces constituting the inner surface, and a low liquid-philicity portion with liquid-philicity lower than the liquid-philic portion is arranged on the inner surface in a second area other than the first area.

16. The droplet discharging apparatus as defined in claim 15, wherein:

the inner surface includes a bottom surface in which a flow port is formed in communication with the nozzle, a top surface which faces the bottom surface, and a side surface which connects the bottom surface and the top surface; entire of the side surface is the liquid-philic portion; and each of the top and bottom surfaces includes the low liquid philicity portion.

17. An inkjet recording apparatus which performs recording of an image on a recording medium, the apparatus comprising:

an inkjet recording head which includes the droplet discharging apparatus as defined in claim 15 for discharging droplets of ink onto the recording medium; and a conveyance device which conveys at least one of the inkjet recording head and the recording medium relatively to each other during the recording.

18. A liquid filling method of filling a liquid into a liquid discharge apparatus comprising a nozzle which discharges a droplet of the liquid, a pressure chamber which is in communication with the nozzle and is filled with the liquid to be discharged as the droplet though the nozzle, and a pressure generation device which generates pressure variation in the liquid inside the pressure chamber to cause the droplet to be discharged through the nozzle, the method comprising the steps of:

adjusting a contact angle of the liquid on an inner surface of the pressure chamber to be not more than an angle formed inside the pressure chamber by two mutually adjacent surfaces constituting the inner surface; and filling the liquid into the pressure chamber, said adjusting step adjusting the contact angle by heating the liquid when the liquid is filled into the pressure chamber.

* * * * *